US010370742B2

(12) United States Patent
Donahue et al.

(10) Patent No.: US 10,370,742 B2
(45) **Date of Patent: *Aug. 6, 2019**

(54) HYPEREUTECTIC ALUMINUM-SILICON CAST ALLOYS HAVING UNIQUE MICROSTRUCTURE

(71) Applicant: Brunswick Corporation, Lake Forest, IL (US)

(72) Inventors: Raymond J. Donahue, Fond du Lac, WI (US); Kevin R. Anderson, Fond du Lac, WI (US); Terrance M. Cleary, Fond du Lac, WI (US); Alexander K. Monroe, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 214 days.

This patent is subject to a terminal disclaimer.

(21) Appl. No.: 15/263,859

(22) Filed: Sep. 13, 2016

(65) Prior Publication Data

US 2017/0298479 A1 Oct. 19, 2017

Related U.S. Application Data

(63) Continuation-in-part of application No. 14/791,646, filed on Jul. 6, 2015, now Pat. No. 9,650,699, which
(Continued)

(51) Int. Cl.
*C22C 1/00* (2006.01)
*C22C 1/04* (2006.01)
(Continued)

(52) U.S. Cl.
CPC ..... *C22C 21/02* (2013.01); *B22D 17/00* (2013.01); *B22D 21/007* (2013.01); *C22C 21/04* (2013.01)

(58) Field of Classification Search
CPC ..... C22C 1/00; C22C 1/04; C22C 1/0416; C22C 21/02; C22C 21/04; C22C 21/14; C22C 21/16; C22C 2200/00
(Continued)

(56) References Cited

U.S. PATENT DOCUMENTS 1,947,121 A 2/1932 Bonsack
2,357,452 A 9/1944 Euclid
(Continued)

FOREIGN PATENT DOCUMENTS

EP 0377615 B1 7/1991
EP 0708884 B1 5/1996
(Continued)

OTHER PUBLICATIONS

Best Practices in Aluminum Metalcasting, AFS Book, Copyright 2014, Geoffrey K. Sigworth on p. 121, in Figs. 8-16 (right side).
(Continued)

*Primary Examiner* — Patricia L. Hailey
(74) *Attorney, Agent, or Firm* — Andrus Intellectual Property Law, LLP

(57) ABSTRACT

A hypereutectic aluminum silicon high pressure die cast alloys is disclosed herein having 16% to 23% by weight silicon, 0.01% to 1.5% by weight iron, 0.01% to 0.6% by weight manganese, 0.01% to 1.3% by weight magnesium, 0.05% to 0.20% by weight strontium and the balance aluminum. The iron constituency may me modified to 0.01% to 0.7% by weight iron, or 0.01% to 0.2% by weight iron. The manganese constituency may be modified to 0.01% to 0.5% by weight manganese. The strontium constituency may be modified to 0.05% to 0.1% by weight strontium. The exhibits an elongation of at least 2%, an average ultimate tensile strength of greater than 250 MPa, and yield strength of greater than 200 MPa. The microstructure has a volume
(Continued)

fraction of primary silicon at greater than 10% and a volume fraction of modified aluminum-silicon eutectic at 45% to 90%.

23 Claims, 14 Drawing Sheets

Related U.S. Application Data is a continuation-in-part of application No. 13/828,765, filed on Mar. 14, 2013, now Pat. No. 9,109,271.

(51) Int. Cl.

| | |
|---|---|
| ***C22C 21/14*** | (2006.01) |
| ***C22C 21/16*** | (2006.01) |
| ***C22C 21/02*** | (2006.01) |
| ***B22D 17/00*** | (2006.01) |
| ***B22D 21/00*** | (2006.01) |
| ***C22C 21/04*** | (2006.01) |

(58) Field of Classification Search
USPC ..... 420/529, 534, 538, 546, 547, 548
See application file for complete search history.

(56) References Cited

U.S. PATENT DOCUMENTS

| | | | | |
|---|---|---|---|---|
| 3,092,744 | A | 6/1963 | Stonebrook | |
| 3,726,672 | A | 4/1973 | Lindberg | |
| 3,881,879 | A | 5/1975 | Singleton, Jr. et al. | |
| 4,297,976 | A | 11/1981 | Bruni et al. | |
| 4,603,665 | A | 8/1986 | Hesterberg et al. | |
| 4,657,067 | A * | 4/1987 | Rapp | C09K 5/063 126/400 |
| 4,821,694 | A | 4/1989 | Hesterberg et al. | |
| 4,966,220 | A | 10/1990 | Hesterberg et al. | |
| 4,969,428 | A | 11/1990 | Donahue et al. | |
| 5,129,378 | A | 7/1992 | Donahue et al. | |
| 5,165,464 | A | 11/1992 | Donahue et al. | |
| 5,234,514 | A | 8/1993 | Donahue et al. | |
| 5,253,625 | A | 10/1993 | Donahue et al. | |
| 5,290,373 | A | 3/1994 | Donahue et al. | |
| 5,303,682 | A | 4/1994 | Donahue et al. | |
| 5,355,930 | A | 10/1994 | Donahue et al. | |
| 5,355,931 | A | 10/1994 | Donahue et al. | |
| 5,383,429 | A | 1/1995 | Donahue et al. | |
| 5,421,292 | A | 6/1995 | Hoffman et al. | |
| 5,564,374 | A | 10/1996 | Hoffman et al. | |
| 5,755,271 | A | 5/1998 | Williamson | |
| 5,965,829 | A | 10/1999 | Haynes et al. | |
| 6,024,157 | A | 2/2000 | Donahue et al. | |
| 6,168,675 | B1 | 1/2001 | Fang et al. | |
| 6,332,906 | B1 | 12/2001 | Haynes et al. | |
| 6,763,876 | B1 * | 7/2004 | Donahue | B22C 9/046 164/258 |
| 6,923,935 | B1 * | 8/2005 | Donahue | C22C 21/02 148/415 |
| 7,666,353 | B2 | 2/2010 | Donahue et al. | |
| 9,650,699 | B1 * | 5/2017 | Donahue | C22C 21/04 |

FOREIGN PATENT DOCUMENTS

| | | | |
|---|---|---|---|
| EP | 1340827 | | 9/2003 |
| EP | 1469091 | | 10/2004 |
| EP | 1591792 | A2 | 11/2005 |
| EP | 1978120 | | 10/2008 |
| GB | 616413 | | 1/1949 |
| GB | 1437144 | A | 5/1976 |
| WO | 8902326 | A1 | 3/1989 |
| WO | 9012899 | A1 | 11/1990 |
| WO | 1992/009711 | | 6/1992 |
| WO | 9503485 | A1 | 2/1995 |

OTHER PUBLICATIONS

Fundamentals of Aluminium Metallurgy, Production, Processing and Applications, edited by Robert Lumley, 2011, pp. 289, 290.

Aluminum Products and Their Fabrication, Junius David Edwards et al., Copyright 1930, pp. 88-90.

Supplementary European Search Report issued in connection with EP 14774932.9, dated Oct. 12, 2016.

Davami et al., "Strontium as a modifying agent for Al—Si eutectic alloy", British Foundry, Institute of British Foundrymen, Chesterfield, GB, vol. 72, No. 4, Jan. 1, 1979, pp. 4-7, XP 009064981, ISSN: 007-0718.

Dinnis et al., "The influence of strontium on porosity formation in Al—Si alloys", Metallurgical and Materials Transactions A: Physical Metallurgy & Materials Scie, ASM International Materials Part, OH, US, vol. 35A, No. 11, Nov. 1, 2004, pp. 3531-3541, XP009064933, ISSN: 1073-5623, DOI: 10.1007/S11661-004-0190-9.

Shabel et al. "Friction and Wear of Aluminum-Silicon Alloys" In: Jan. 1, 1992, ASM International, XP55447945, vol. 18, pp. 785-794, DOI: 10.1361/asmhba0002331.

Extended European Search Report, European Patent Appln. No. 17020405.1, dated Feb. 13, 2018.

* cited by examiner

HYPEREUTECTIC ALUMINUM-SILICON CAST ALLOYS HAVING UNIQUE MICROSTRUCTURE

CROSS-REFERENCE TO RELATED APPLICATIONS

This application is a continuation-in-part of U.S. patent application Ser. No. 14/791,646, filed Jul. 6, 2015, which is a continuation-in-part of U.S. patent application Ser. No. 13/828,765, filed Mar. 14, 2013, which are incorporated herein by reference in entirety.

STATEMENT REGARDING FEDERALLY SPONSORED RESEARCH OR DEVELOPMENT FIELD

Not Applicable.

INCORPORATION-BY-REFERENCE OF MATERIAL SUBMITTED ON A COMPACT DISC

Not Applicable.

BACKGROUND

The eutectic structure of aluminum silicon alloys has long been studied to determine the mechanical properties of the alloys, see U.S. Pat. Nos. 1,387,900 and 1,410,461. After more than 80 years of studying this eutectic structure, those skilled in the art now understand that sodium or strontium additions to the eutectic melt in only 100 ppm concentrations changes the size and morphology of the eutectic silicon phase resulting in a significant increase in the alloy's ductility.

Still, hypereutectic aluminum silicon alloys are not used to a great extent in sand casting processes because they are difficult to machine and because the primary silicon particle size is larger at sand casting cooling rates than at cooling rates for casting processes that use metal molds. As a result, there is a requirement to control the casting's microstructure in order to achieve an acceptable machinability. Achieving an acceptable machinability in a hypereutectic alloy is typically accomplished through phosphorus additions to the alloy melt to refine the primary silicon particle size. However, phosphorus prefers to form phosphides with common melt additives such as strontium and sodium rather than reacting with aluminum to form aluminum phosphide. This is problematic because aluminum phosphide is the nucleus for primary silicon formation in the eutectic structure of hypereutectic aluminum silicon alloys. Accordingly, the eutectic structure of phosphorus containing hypereutectic aluminum silicon alloys is always unmodified.

Thus, phosphorus refined, solution heat treated, quenched and aged, hypereutectic aluminum silicon structures provide the baseline for machinability, yet this baseline generally requires diamond tooling for proper machining. In contrast, eutectic aluminum silicon alloys and hypoeutectic aluminum silicon alloys, where the eutectic silicon structure is modified with strontium or sodium additions, have increased ductilities and are easier to machine. However, when the modified eutectic in the hypoeutectic alloy structures are compared to unmodified structures, the strontium or sodium modified eutectic structures exhibit nearly identical machinability in the heat treated condition with the unmodified structures. It is believed that this equivalence in machinability is due to the eutectic silicon phase occurring as a continuous phase in the eutectic whether the eutectic is modified or unmodified. Further, since it is always easier to machine the less ductile T6 or T7 heat treated condition, compared to the as cast condition, there is an effect that base metal properties have on machinability that is quite significant. Accordingly, there is not a predictable treatment that improves machinability of hypereutectic aluminum silicon alloys.

Hypereutectic aluminum alloy B391 (AA B391) includes 18 to 20% silicon by weight for wear resistance, 0.4 to 0.7% by weight magnesium for aging response to increase strength and has maximums for iron and copper of 0.2% by weight for good sand casting attributes, and is the only hypereutectic aluminum silicon alloy registered for sand casting by the Aluminum Association. The 0.2% by weight maximum copper constituency ensures that (for any given silicon content), the solidification range, that is, the temperature difference between the liquidus and solidus, is at a minimum. In comparison, AA 390 has the same range of elements as AA B391, except AA 390 has 4.5% by weight copper constituency. Thus, the narrow solidification range of AA B391 occurs primarily because the significantly lower copper constituency raises the solidus melting point by nearly 100° Fahrenheit compared to AA 390.

The narrow solidification range of AA B391 is important because the primary silicon, which is less dense than the molten alloy, it is less likely to float and segregate upon precipitation in an alloy of narrow solidification range. The low iron and manganese contents of AA B391 are desirable and are particularly attractive for a sand cast hypereutectic aluminum silicon alloy that solidifies slowly. The mechanical properties of AA B391 are significantly degraded when the iron phase grows large during the slow cooling, because a needle like morphology results for the iron phase, degrading mechanical properties.

Historically, nickel was an essential element in Y alloy (4% by weight copper, 2% by weight nickel, 1.5% by weight magnesium, balance aluminum), developed during World War I. Nickel is present in only three registered alloys with the Aluminum Association today in concentrations between 2% and 3% nickel. Thus, it is known to use nickel as a minor constituent in some aluminum copper alloys, such as AA 242, AA 336 and AA 393, wherein the element imparts high strength at high temperature. AA 242 has a formulation of 3.7 to 4.5% by weight copper, 1.2 to 1.7% by weight magnesium, 1.8 to 2.3% by weight nickel and balance aluminum. AA 336 has 11 to 13% by weight silicon, 1.2% by weight maximum iron, 0.5 to 1.5% by weight copper, 0.7 to 1.3% by weight magnesium, 2.0 to 3.0% by weight nickel and balance aluminum. Similarly, AA 393 has a hypereutectic formulation of 21 to 23% by weight silicon, 1.3% by weight maximum iron, 0.7 to 1.1% by weight copper, 0.7 to 1.3% by weight magnesium, 2.0 to 2.5% by weight nickel and balance aluminum.

Additionally, more than forty years ago, there was considerable interest in the Al—$NiAl_3$ eutectic, unidirectionally solidified, as a fiber reinforced material, especially for high temperature applications. As identified in the reference to B. K. Agrawal, Met A 6, 152605, in the book, Aluminum Alloys: Structure and Properties by L. F. Mondolfo page 339 (Butterworth Publications Ltd, 1976), by directional freezing, the eutectic may be made to crystallize with the $NiAl_3$ fibers aligned in the direction of growth, with the spacing between the fibers dependent on the freezing rate. The same reference indicates that additions of barium, cerium and cesium to the unidirectionally solidified Al—$NiAl_3$ eutectic changes the solidification pattern from colony to dendritic It is also known that aging after quenching from high temperature does not produce hardening of binary Al—Ni alloys to be of practical use.

However, the addition of nickel in concentrations approaching 6% to aluminum silicon magnesium casting alloys, aluminum silicon copper casting alloys, aluminum silicon copper magnesium alloys or aluminum copper casting alloys have not been studied. This is because it is known that nickel additions of 2% by weight or less have the effect of reducing hot shortness in some castings and also have the effect of reducing the coefficient of thermal expansion.

Additionally, U.S. Pat. No. 6,168,675 describes a hypereutectic aluminum silicon alloy having 2.5 to 4.5% by weight nickel, but with a very high manganese content of 1.2% maximum by weight and a very high iron content of 1.2% by weight maximum. This alloy is intended for the die casting process or permanent mold casting process to make vehicular disk brake components. Because of the high manganese and iron contents, this alloy has a very high heavier metal content that requires a high holding temperature to prevent the heavier metals from dropping out. Furthermore, the high manganese content is necessary to modify the needle like beta iron aluminum phase to the alpha iron aluminum phase and increases the yield strength, tensile strength and elongation, both at ambient and high temperatures. Notwithstanding the attributes imparted to the alloy from high levels of manganese and iron, the alloy of U.S. Pat. No. 6,168,675 would not be suited for a slow cooling process like sand, lost foam or investment casting because the large needle like iron phase particles would form, even with the high levels of manganese, thereby hindering feeding during solidification which results in increased porosity levels and decreased ductility levels.

Sand casting processes are increasingly being used to cast complex metal products. Sand casting procedures include lost foam casting, lost foam with pressure casting, green sand casting, bonded sand casting, precision sand casting and investment casting. Perhaps the most beneficial and economical of these types of castings is lost foam casting with pressure. Such a method is described in U.S. Pat. No. 6,763,876 entitled Method And Apparatus For Lost Foam Casting Of Metal Articles Using External Pressure, the subject matter of which is incorporated herein by reference. All of the above discussion does not mean that die casting alloys containing nickel or nickel-free cannot be made more machinable if the primary silicon particle size is small and the eutectic is modified, which has not heretofore been demonstrated.

SUMMARY

One embodiment of the present invention is directed to a hypereutectic aluminum silicon alloy having improved machinability with additions of nickel consisting essentially of 18 to 20% by weight silicon, 0.3 to 1.2% by weight magnesium, 3.0 to 6.0% by weight nickel, 0.6% by weight maximum iron, 0.4% by weight maximum copper, 0.8% by weight maximum manganese, 0.5% by weight maximum zinc and the balance aluminum. The nickel content of the alloy of the present invention may be modified to constitute 4.5% to 6% by weight, and be substantially free of iron and manganese. The alloy of the present invention has additional benefits, particularly when compared to copper containing hypereutectic aluminum silicon alloys. Such benefits include improved feeding of shrinkage porosity through an Al—$NiAl_3$ eutectic structure under ten atmospheres of isostatic gas pressure and improved galvanic couple compatibility (over an Al—Ni galvanic couple) on the micron level for constituents in the microstructure for a wet gasket joint containing salt water.

The present invention discloses a hypereutectic alloy composition that, upon solidification, goes through an $AlNiAl_3$ eutectic reaction, and involves the creation of a ternary eutectic comprised of the eutectic Si phase, the eutectic Al—$NiAl_3$ phase and the eutectic Al phase on slow cooling (as opposed to fast cooling of the die casting process), that resembles a "Chinese script" compacted, blocky morphology for the eutectic $NiAl_3$ phase, instead of an elongated needle-like morphology. This microstructural morphology is embedded in the eutectic that surrounds the primary silicon, outlining and partitioning the primary silicon particles, while providing a semi-continuous fracture path through the eutectics that imparts good machinability to a hypereutectic aluminum silicon alloy that normally is difficult to machine. Further, it is important that the alloy of the present invention be substantially free of iron and manganese because if iron phases and manganese phases are in the microstructure, they clog interdendritic passageways and hinder feeding, decreasing machinability even when ten atmospheres of isostatic pressure is applied.

Thus, the $NiAl_3$ Chinese script compacted, blocky morphology exists throughout the microstructure of the alloy of the present invention to enhance machinability and facilitate improved elevated temperature properties. This finding is quite surprising since normally microstructural features that enhance machinability, such as sulfides in steel, also degrade mechanical properties.

The hypereutectic aluminum silicon alloy of the present invention also has anticipated use in the lost foam casting process for engine components such as engine blocks, engine heads, and pistons, particularly such engine components used in salt water and thus requiring high corrosion resistance and high mechanical properties (through low porosity levels) both at ambient temperatures and elevated temperatures.

Accordingly, the hypereutectic aluminum silicon sand cast alloy of the present invention consists essentially of 18-20% by weight silicon, 0.3-1.2% by weight magnesium, 3.0-6.0% by weight nickel, 0.8% by weight maximum iron, 0.4% by weight maximum copper, 0.6% by weight maximum manganese, 0.5% by weight maximum zinc, and the balance aluminum. Alternatively, the copper content may be 0.2% by weight maximum copper, the iron content may be 0.6% by weight maximum iron, and the zinc content may be 0.1% by weight maximum zinc. Alternatively, the aluminum silicon sand cast alloy of the present invention may consist essentially of 18-20% by weight silicon, 0.3-0.7% by weight magnesium, 3.0-6.0% by weight nickel, 0.2% by weight maximum iron, 0.2% by weight maximum copper, 0.3% by weight manganese, 0.1% by weight maximum zinc, and the balance aluminum, wherein the alloy sand cast using a lost foam casting process with the pressure. As a further alternative, the hypereutectic aluminum silicon alloy of the present invention may consist essentially of 18-20% by weight silicon, 0.3-1.2% by weight magnesium, 4.5-6.0% by weight nickel, 0.8% by weight maximum iron, 0.4% by weight maximum copper, 0.6% by weight maximum manganese, 0.5% by weight maximum zinc, and the balance aluminum.

When the hypereutectic aluminum sand cast alloy of the present invention is cast, the sand casting procedure is selected from one of the following sand cast procedures: Lost Foam Casting, Lost Foam Casting with Pressure, Green Sand Casting, Bonded Sand Casting, Precision Sand Casting, or Investment Sand Casting.

In one embodiment, the hypereutectic aluminum silicon sand cast alloy of the present invention has a T6 heated treated microstructure of primary silicon particles embedded in the ternary eutectic comprised of eutectic Si, eutectic $NiAl_3$, and eutectic Al, and is substantially free of unsolutionized $Mg_2Si$ phases and $Cu_3NiAl_6$ in Chinese script compacted, blocky form. In this embodiment of the alloy, the amount of the eutectic $NiAl_3$ phase is between 5% and 15% by weight, and by further be between 5% and 14.3% by weight. Additionally, the eutectic $Cu_3NiAl_6$ phases are present at less than 1% by weight.

As aforementioned, the nickel constituency of the hypereutectic aluminum silicon sand cast of the present invention may be narrowed to the 4.5-6.0% by weight nickel. If this constituency is used, the alloy has a T6 heat treated microstructure wherein primary silicon particles are embedded in the eutectics of Al—Si and Al—$NiAl_3$, and the microstructure is generally free of unsolutionized $Mg_2Si$ phases and $Cu_3NiAl_6$ in Chinese script form, while the amount of the eutectic $NiAl_3$ phase is greater than 10% by weight.

Additional adjustments to the hypereutectic aluminum silicon sand cast alloy constituency may be made. Particularly, the iron content may be lowered to be 0.2% by weight maximum iron; the copper content may be lowered to 0.2% by weight maximum copper; the manganese content may be lowered to 0.3% by weight maximum manganese; and the magnesium content may be modified to 0.75-1.2% by weight. Further, up to 2% by weight nickel may be substituted with up to 2% by weight cobalt. Also, a grain or silicon refining element may be added to the alloy. Preferably, the grain or silicon refining elements are either titanium or phosphorus.

When the hypereutectic aluminum silicon sand cast alloy of the present invention is cast using a lost foam casting process with pressure, the alloy would preferably consist essentially of 18-20% by weight silicon, 0.3-7% by weight magnesium, 3.0-6.0% by weight nickel, 0.2% by weight maximum iron, 0.2% by weight maximum copper, 0.3% by weight maximum manganese, 0.1% by weight maximum zinc and the balance aluminum. The alloy may further include phosphorous in the range of 0.005%-0.1% by weight for refining purposes. Preferably, pressure is applied to a molten metal casting in accordance with procedures of U.S. Pat. No. 6,763,876 the substance of which is incorporated herein by reference. Most preferably, pressure is applied after ablation of a polymeric foam gating system that connects the source of molten liquid metal to a polymeric foam pattern, but before molten metal fully ablates the polymeric foam pattern. Pressure is applied in the range of 5.5-15 atmospheres at a rate faster than 1 atmosphere per 12 seconds. The polymeric foam pattern may have nearly any configuration, however, to take advantage of the improved galvanic coupled compatibility of the present invention, the pattern is most preferably of an engine head, pistons for internal combustion engines, or engine blocks to be used in engines that run in salt water environment. Internal combustion engine blocks cast with the hypereutectic aluminum silicon sand cast alloy in the present invention exhibit a porosity level of less than 0.5%.

The resulting as cast Lost Foam microstructure comprises primary silicon particles embedded in a mixture of aluminum-silicon eutectic, wherein the eutectic silicon phase is unmodified and an aluminum-$NiAl_3$ eutectic is present and further wherein the $NiAl_3$ phase comprises a Chinese script compacted, blocky morphology imparting improved machinability on the alloy. Specifically, if the weight percent of $NiAl_3$ phase exceeds the weight percent of a primary aluminum silicon phase, the alloy provides a low energy fracture path in the machining process for improved machinability. The machinability of the alloy improves linearly when the nickel constituency increases from 3% by weight to 6% by weight nickel, because the weight percent of $NiAl_3$ correspondingly increases from 7% to 14% in the eutectic. When the hypereutectic aluminum silicon sand cast alloy of the present invention is cast using the casting process of U.S. Pat. No. 6,763,876, the alloy is cooled at a rate typical of sand casting cooling. The microstructure of such an alloy exhibits less coring than if they alloy was cast using a die casting process, and, advantageously, the porosity level is generally less than 1%.

It is contemplated that the hypereutectic aluminum silicon alloy of the present invention may be used for other types of casting processes. If this is the case, the nickel constituency should be 4.5-6.0% by weight nickel with corresponding 0.8% by weight maximum iron constituency. Such an alloy may be used in either the die casting process or in a permanent mold casting process or in a semi-permanent mold casting process with sand cores, as well as the sand casting procedures described, above. Such an alloy has a T6 heat treated microstructure of primary silicon particles embedded in ternary eutectics of eutectic Si, eutectic $NiAl_3$, and eutectic Al is generally free of unsolutionized $Mg_2Si$ phases and $Cu_3NiAl_6$ in Chinese script compacted, blocky morphology form. The amount of the eutectic $NiAl_3$ phase is between 5% and 15% by weight, and the $NiAl_3$ phase has a Chinese script compacted, blocky morphology.

In other embodiments, 0.03-0.2% by weight strontium may be added to the alloy. In one such embodiment, the alloy comprises 18-20% by weight silicon; 3-6% by weight nickel; and 0.03-0.20% by weight strontium, with the alloy being substantially free of iron, copper and manganese such that no positive additions of iron, copper or manganese are added, but recognizing that impurities may exist. In another embodiment the alloy consists essentially of 18-20% by weight silicon, 3-6% by weight nickel, 0.3-1.2% by weight magnesium, 0.03-0.20% (alternatively 0.03 to 0.18%) by weight strontium, and the balance aluminum, where the alloy is substantially free of iron, copper and manganese. The alloy avoids die soldering, has a microstructure having primary silicon particles less than 20 microns in size and has an elongation of greater than 2%.

Other embodiments with the strontium addition permit up to 0.4% by weight iron, 0.01 to 1.0% by weight iron or 0.01 to 1.2% by weight iron. Further, these embodiments with strontium may substitute 0.1%-2.0% by weight nickel with 0.1%-2.0% by weight cobalt. Still other embodiments contemplate an alloy comprising 14-20% by weight silicon; 0.03-0.20% by weight strontium; 0.1-1.2% by weight iron; with the alloy being substantially free of copper (e.g. less than 0.20% by weight) and manganese (e.g. less that 0.30% by weight) such that no positive additions of copper are added, but recognizing that impurities to the exemplary levels noted above may exist. 0.40-0.70% by weight magnesium may be added to this embodiment of the alloy. The alloy is substantially free of copper and manganese, avoids die soldering, has a microstructure having primary silicon particles less than 20 microns in size and has an elongation of greater than 2%. Further, the nickel constituency may be either zero, or 3-6% by weight nickel. As explained herein, this alloy embodiment, with or without nickel, because it is substantially free of copper, has a high solidus temperature and a narrow solidification contributing to a more uniform distribution of the primary silicon and more effective wear resistance.

In still other embodiments, a hypereutectic high pressure die cast aluminum silicon alloy having 16% to 23% by weight silicon, 0.01% to 1.5% by weight iron, 0.01% to 0.6% by weight manganese, 0.01% to 1.3% by weight magnesium, 0.05% to 0.20% by weight strontium and the balance aluminum is disclosed. This alloy may also include 0.01% to 4.5% by weight nickel, but the nickel constituency may also be excluded. The iron constituency may me modified to 0.01% to 0.7% by weight iron, or 0.01% to 0.2% by weight iron. The manganese constituency may be modified to 0.01% to 0.5% by weight manganese. The strontium constituency may be modified to 0.05% to 0.1% by weight strontium. This embodiment, when cooled at high pressure die casting cooling rates, demonstrates significant structural and microstructural advantages. Particularly, the structural advantages include an elongation of at least 2%, an average ultimate tensile strength of greater than 250 MPa, and yield strength of greater than 200 MPa. The microstructure of this high pressure die cast aluminum silicon alloy has a volume fraction of primary silicon at greater than 10%, and in one embodiment between 10% to 20%, a volume fraction of modified aluminum-silicon eutectic at 45% to 90%, and the balance of the microstructure primary aluminum. The microstructural advantages include a volume fraction of primary silicon being surrounded by divorced eutectic aluminum, a volume fraction of primary silicon surrounded by a modified eutectic containing a fibrous eutectic silicon phase, and dendritic primary aluminum with an average dendrite arm spacing of less than 15 μm. The volume fraction of primary aluminum, including the modified eutectic that surrounds the aluminum dendrites, is larger than the volume fraction of primary silicon. Also, the primary aluminum dendritic arm spacing is larger than the average silicon particle size.

All of the strontium-added embodiments are die casting alloys, and may be die cast while avoiding die soldering using any die casting process, including high pressure die casting (HPDC).

DETAILED DESCRIPTION OF

FIG. 1 demonstrates the binary Al—Si phase diagram.

Figure 8:
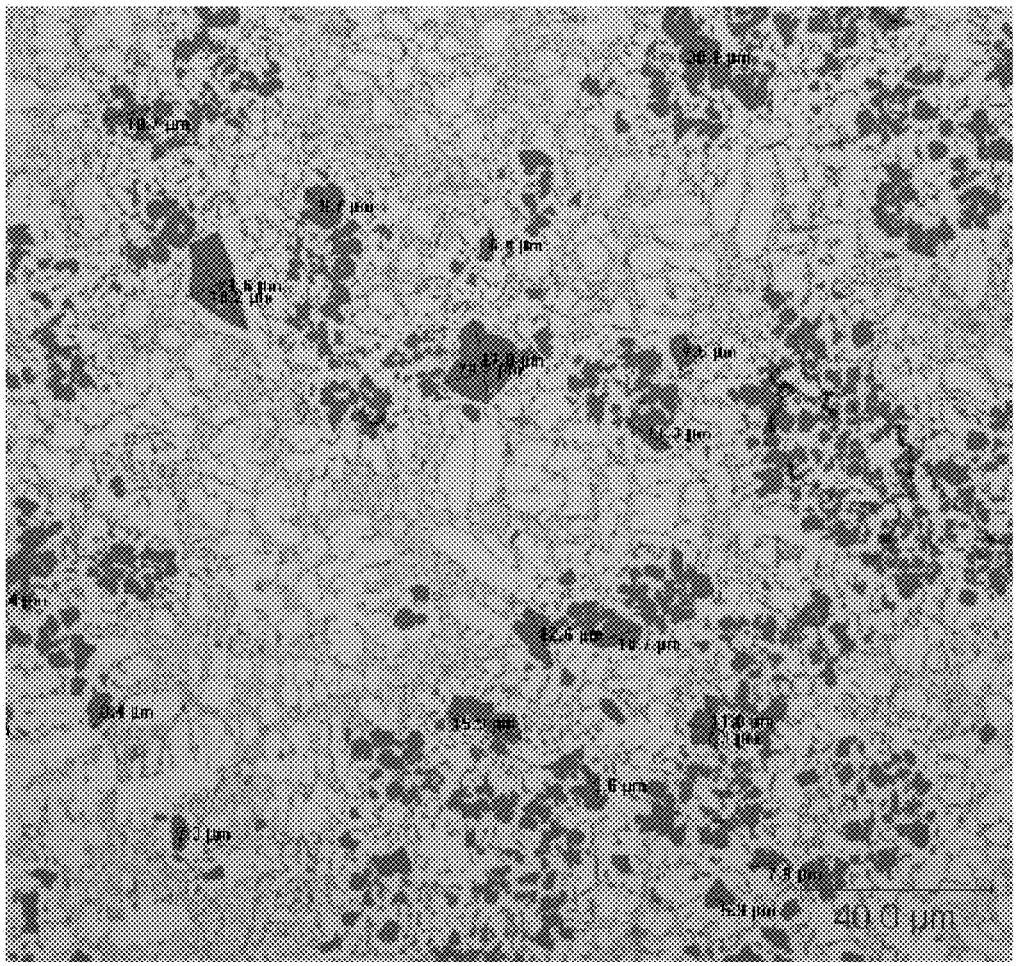

FIG. 8 is the microstructure of the alloy of present application with 0.05% strontium and demonstrating highly refined primary silicon microstructure; the primary silicon volume fraction is approximately 20%, or nearly twice that of conventional hypereutectic Al—Si alloys, and the primary silicon is surrounded by a divorced eutectic aluminum phase; modified eutectic surrounds primary aluminum dendrites; the volume fraction of primary aluminum is larger than the volume fraction of primary silicon.

Figure 9:
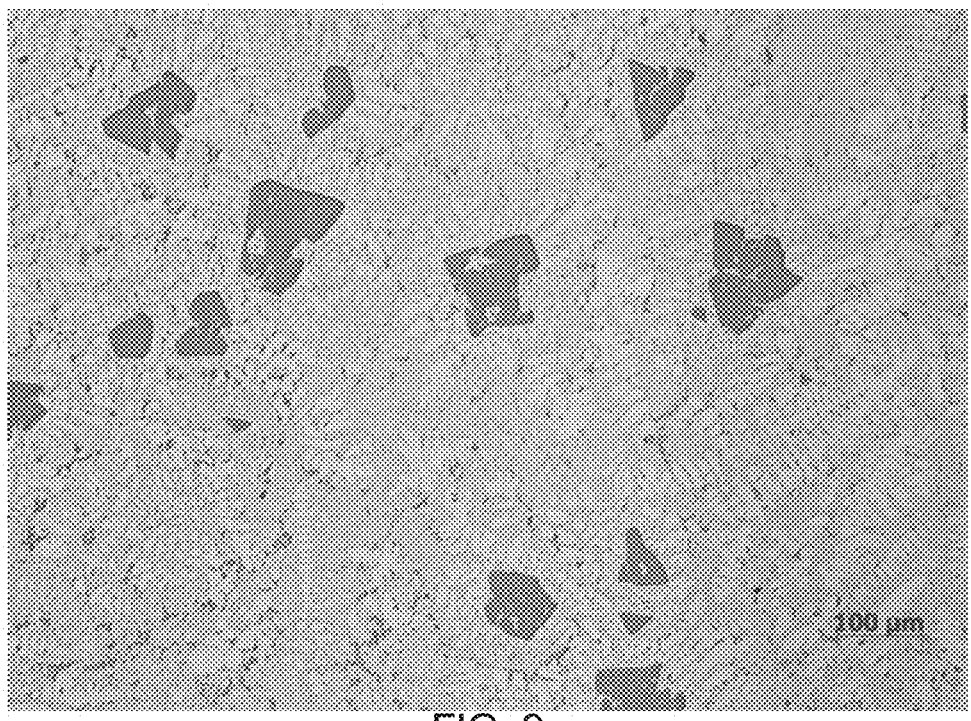

FIG. 9 is the microstructure of a button spectrometer sample (diameter 6.5 cm and 7 mm thick) made by gravity pouring 100 grams of molten AA 391 alloy but with only a 0.016% Sr addition into a permanent mold; the primary silicon particle size is 100 microns.

Figure 10:
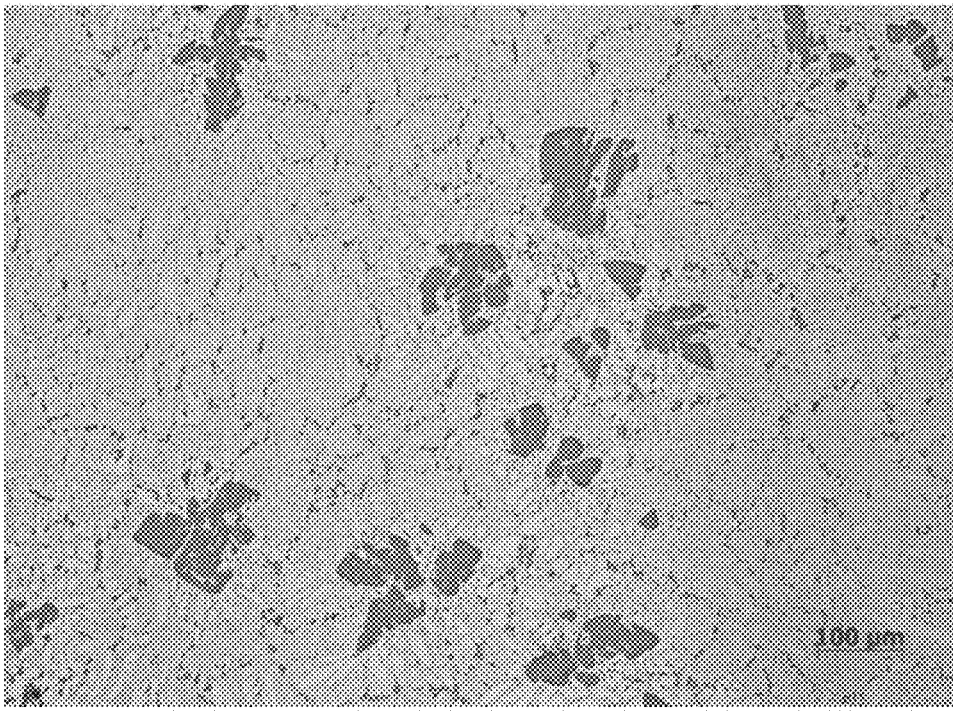

FIG. 10 is the microstructure of a button spectrometer sample (diameter 6.5 cm and 7 mm thick) made by gravity pouring 100 grams of molten AA 391 alloy having a 0.030% Sr addition into a permanent mold, and is different than the microstructure of FIG. 8.

Figure 11:
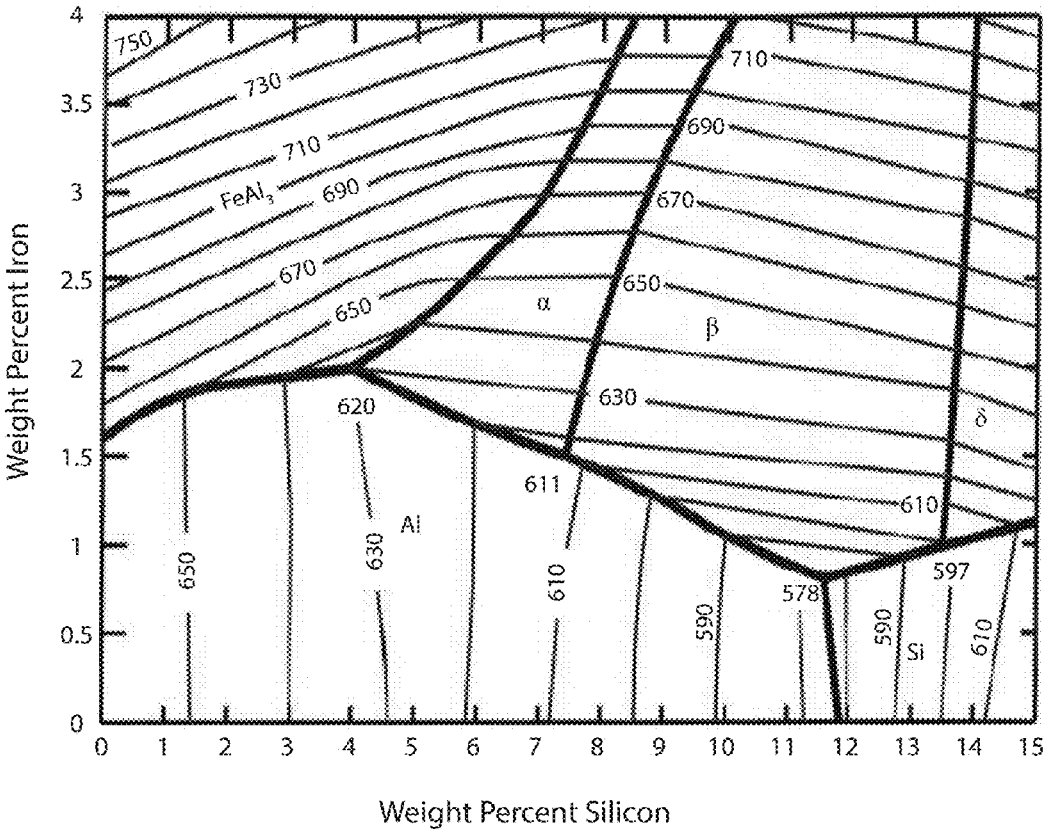

FIG. 11 is a ternary phase diagram for the Al—Si—Fe system, showing the liquidus surface in degrees C.

Figure 12:
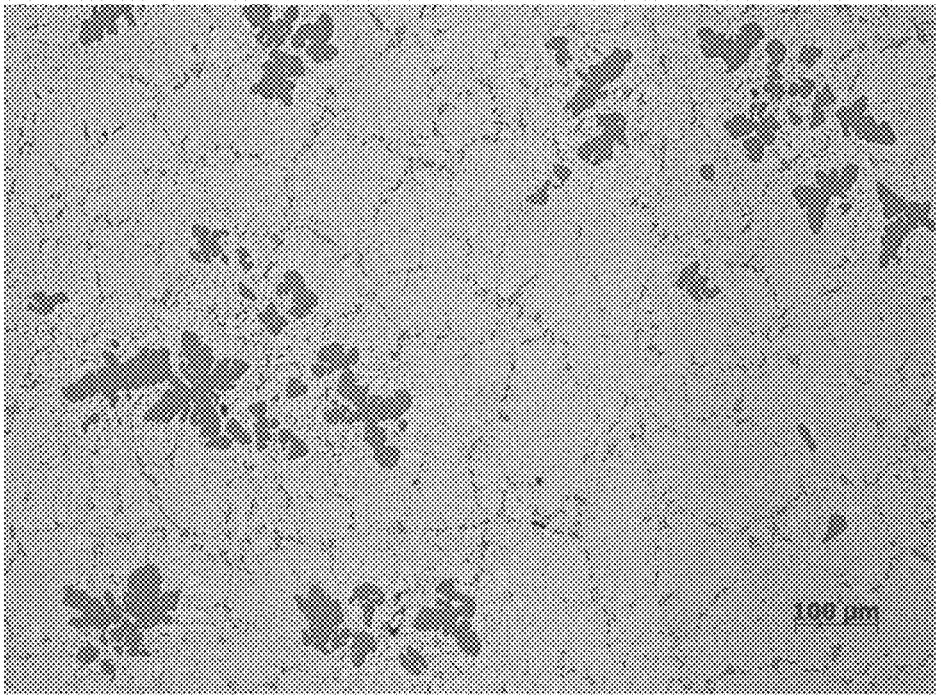

FIG. 12 is the microstructure of a button spectrometer sample (diameter 6.5 cm and 7 mm thick) made by gravity pouring 100 grams of a molten alloy of the present invention having a 0.04% by weight strontium addition.

Figure 13:
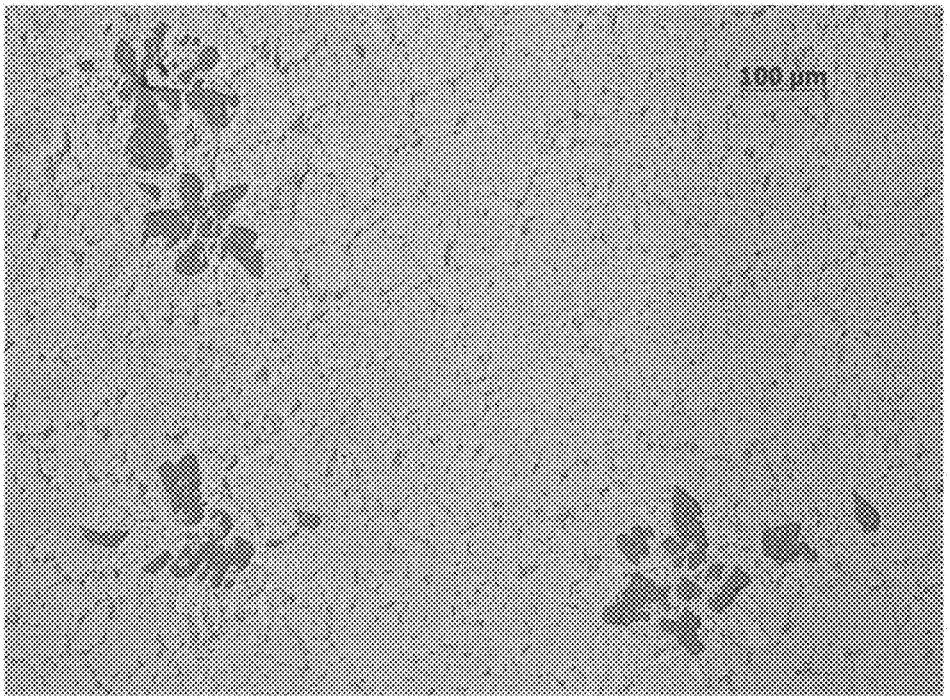

FIG. 13 is the microstructure of a button spectrometer sample (diameter 6.5 cm and 7 mm thick) made by gravity pouring 100 grams of a molten alloy of the present invention having a 0.06% by weight strontium addition.

Figure 14:
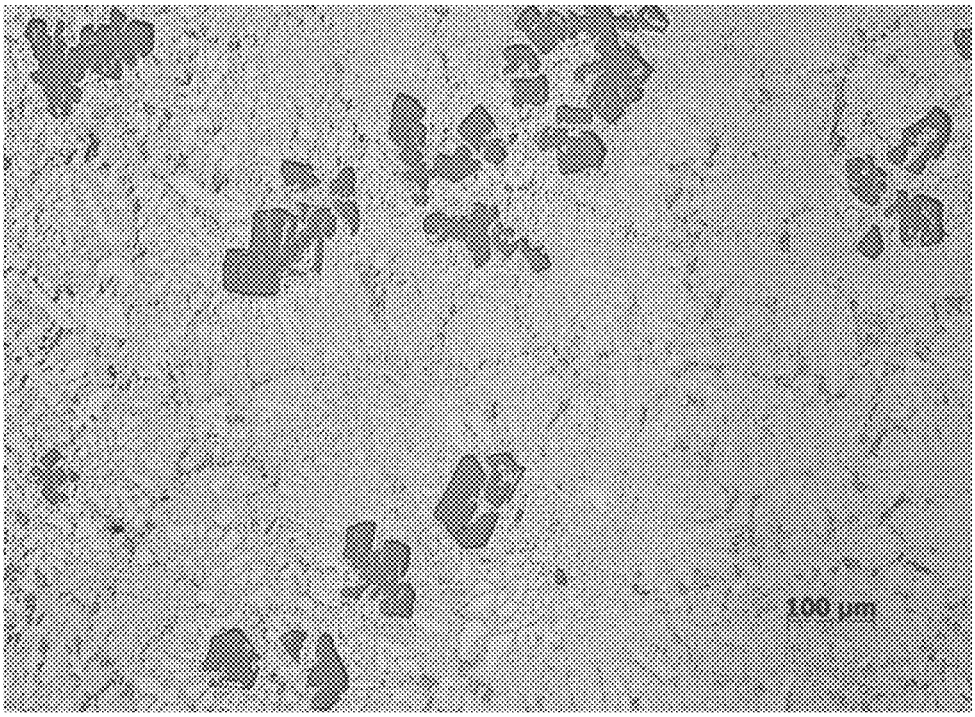

FIG. 14 is the microstructure of a button spectrometer sample (diameter 6.5 cm and 7 mm thick) made by gravity pouring 100 grams of a molten alloy of the present invention having a 0.09% by weight strontium addition.

Figure 15:
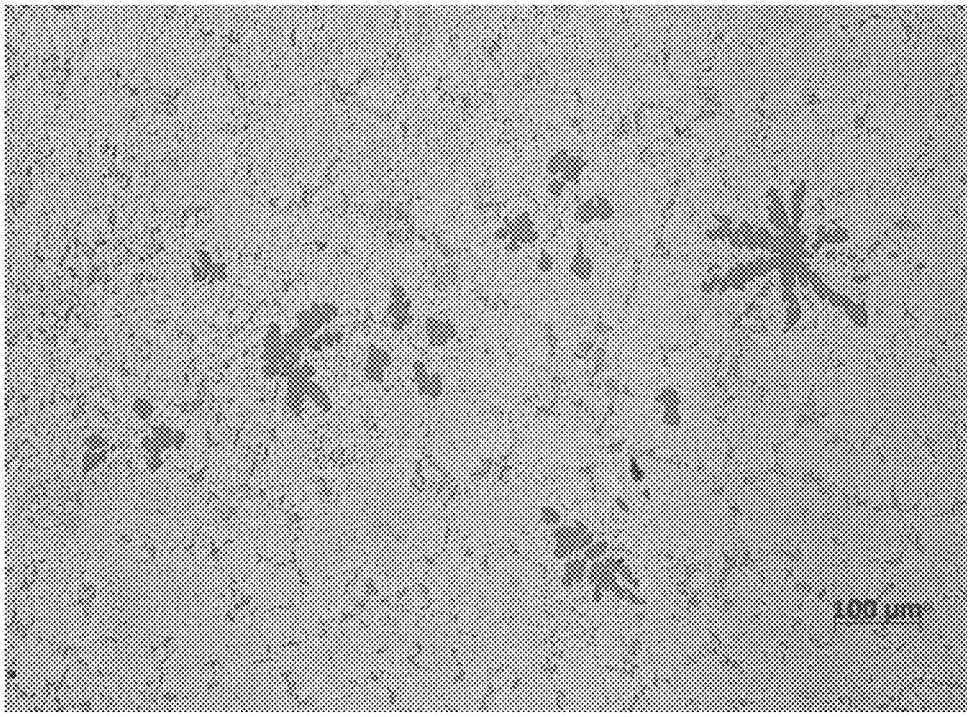

FIG. 15 is the microstructure of a button spectrometer sample (diameter 6.5 cm and 7 mm thick) made by gravity pouring 100 grams of a molten alloy of the present invention having a 0.18% by weight strontium addition.

Figure 16:
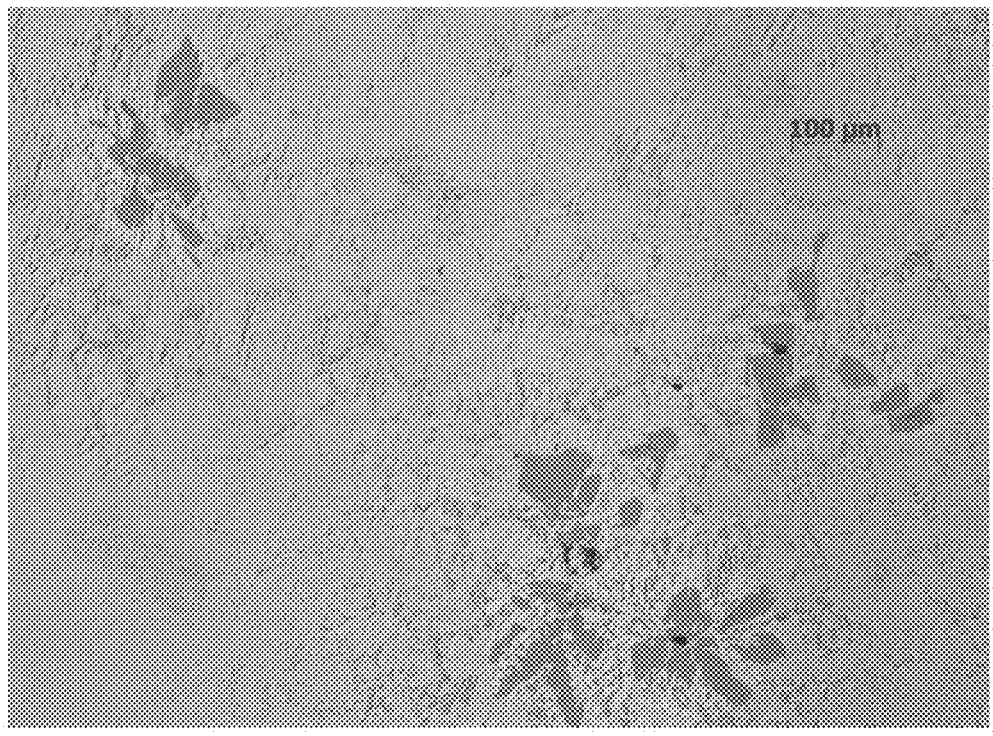

FIG. 16 is the microstructure of a button spectrometer sample (diameter 6.5 cm and 7 mm thick) made by gravity pouring 100 grams of a molten alloy of the present invention having a 0.05% by weight strontium and 4% by weight nickel additions.

Figure 17:
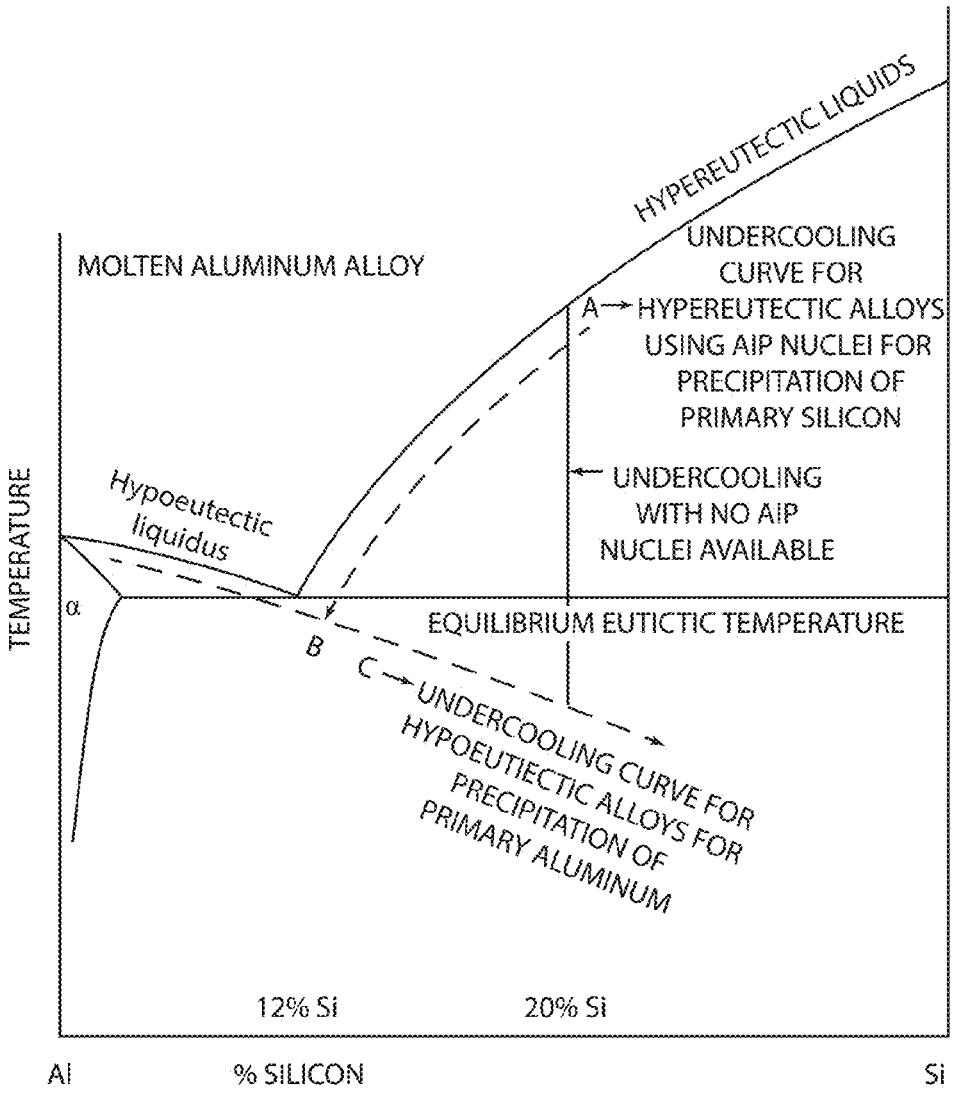

FIG. 17 is an aluminum-silicon phase diagram demonstrating solidification sequences for an alloy exhibiting the microstructure of FIG. 8.

Figure 18:
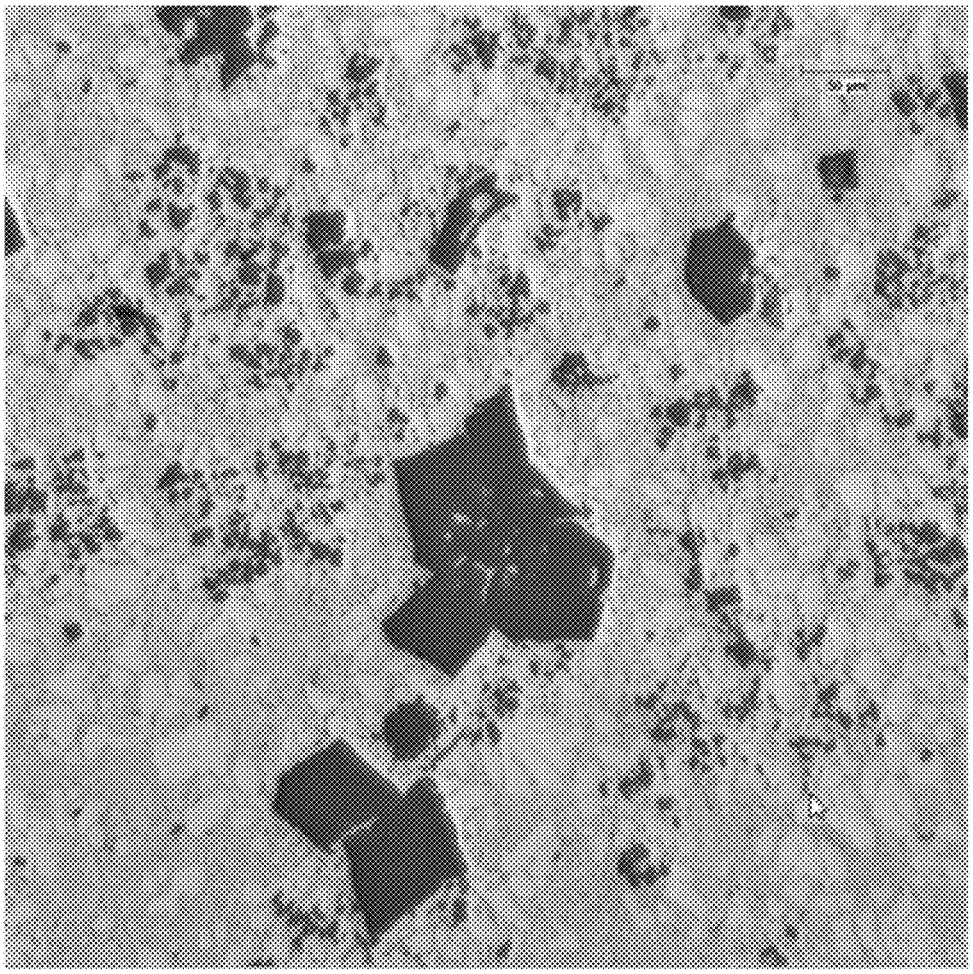

FIG. 18 is the microstructure of a high pressure die cast bearing carrier spool casting having the following composition by weight percentage: 20.4% Si, 0.65% Mg, 0.26% Fe, 0.07% Cu, 0.04% Mn, 0.022% Sr, and the balance Al.

Figure 19:
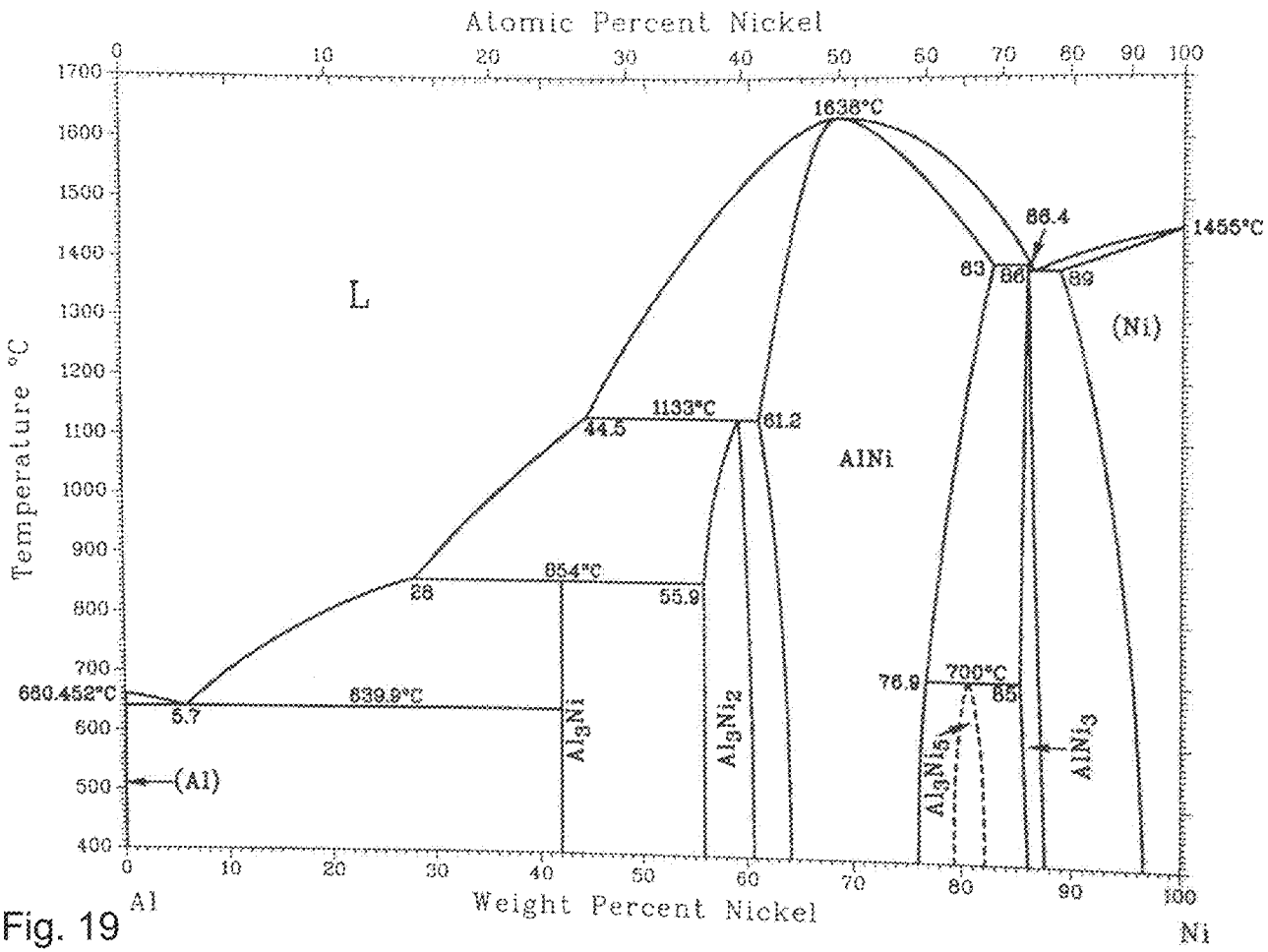

FIG. 19 is the binary Al—Ni phase diagram.

DETAILED DESCRIPTION

The hypereutectic aluminum silicon sand cast alloy of the present invention preferably has the following constituency in weight percentage: 18-20% silicon, 0.3-1.2% magnesium, 3.0-6.0% nickel, 0.8% maximum iron, 0.4% maximum copper, 0.6% maximum manganese, 0.5% maximum zinc, balance aluminum. Alternatively, the copper content may be 0.2% by weight maximum copper, the iron content may be 0.6% by weight maximum iron, and the zinc content may be 0.1% by weight maximum zinc.

The hypereutectic aluminum silicon sand cast alloy of the present invention may have a more narrow nickel content of 4.5-6.0% by weight; a more narrow iron content of 0.2% by weight maximum, a more narrow copper content of 0.2% by weight maximum; a more narrow manganese content of 0.3% by weight maximum and a more narrow magnesium content of 0.75-1.2% by weight. Furthermore, up to 2.0% by weight nickel to be substituted with up to 2.0% by weight cobalt, and grain refining elements such as titanium or phosphorus may be added.

The alloy of the present invention may be sand cast using known sand cast procedures such as Lost Foam Casting, Lost Foam Casting with Pressure, Green Sand Casting, Bonded Sand Casting, Precision Sand Casting, or Investment Casting. If the hypereutectic aluminum silicon alloy is cast using a lost foam casting process with pressure, the alloy may have the following constituency in weight percentage: 18-20% silicon 0.3-0.7% magnesium, 3.0-6.0% nickel, 0.2% maximum iron, 0.2% maximum copper, 0.3% maximum manganese 0.1% maximum zinc, balance aluminum. A beneficial lost foam casting process with pressure is described in U.S. Pat. No. 6,763,876. If phosphorus is added as a refiner, phosphorus should be added to the composition in the range of 0.005%-0.1% by weight.

Alternatively, the hypereutectic aluminum silicon alloy of the present invention may have the following constituency in weight percentage: 18-20% silicon, 0.3-1.2% magnesium, 4.5-6.0% nickel, 0.8% maximum iron, 0.4% maximum copper, 0.6% maximum manganese, 0.5% maximum zinc, balance aluminum. This alloy is adaptable to be used in the die casting, permanent mold casting, and the semi-permanent mold casting with sand cores processes, as well as the traditional sand casting processes noted above. This alternative alloy may be modified to contain 0.3-0.7% by weight magnesium; 0.6% by weight maximum iron, 0.2% by weight maximum manganese, 0.2% by weight maximum copper; and 0.1% by weight maximum zinc. Furthermore, up to 2% by weight nickel may be substituted with up to 2% by weight cobalt. Further, the constituency may be modified to contain 0.75-1.2% by weight magnesium or 0.2% by weight maximum iron.

In another alternative, the hypereutectic aluminum silicon alloy of the present invention may have the following constituency in weight percentage: 18-20% silicon, 0.3-1.2% magnesium, 3-6% nickel, 0.03-0.20 strontium, and the balance aluminum, where the alloy is substantially free of iron, copper and manganese. In other words, no positive additions of iron, copper or manganese are added, but impurities in the casting stock may exist. As discussed in U.S. Pat. No. 7,666,353 (incorporated herein by reference), the 0.03-0.20% strontium addition prevents die soldering to die casting dies in any die casting process, including high pressure die casting (HPDC). Here, it was surprisingly found that 0.03-0.20% by weight strontium addition to the hypereutectic alloy having 18-20% silicon, 3-6% by weight nickel, and 0.3-1.2% by weight magnesium while being substantially free of iron, copper and manganese avoids die soldering. Such die cast alloys also permit ductile die casting, with resultant castings exhibiting an elongation larger than any other hypereutectic aluminum silicon alloy. This hypereutectic alloy having the strontium addition further exhibits the distinct advantages of the nickel addition is providing enhanced machinability.

In other embodiments the hypereutectic die cast alloy may have 0.05-0.10% by weight strontium. The alloy may also have a nickel consistency of 4.5-6.0% by weight. Also, 0.1-2.0% by weight of the nickel consistency may be substituted with 0.1-2.0% by weight cobalt.

In yet other embodiments, a hypereutectic die cast alloy comprises 18-22% by weight silicon, 0.03-0.20% by weight strontium, 3-6% by weight nickel, 0.4% by weight maximum iron, and the balance aluminum. In other embodiments, the iron consistency is 0.01-0.40% by weight iron. In other embodiments, the nickel consistency may be 4.5-6.0% by weight nickel. Again, 0.1-2.0% by weight of nickel may be substituted with 0.1-2.0% by weight cobalt. Such alloys are substantially free of copper and manganese except for impurities.

In further embodiments, the alloy comprises 14-20% by weight silicon; 0.03-0.20% by weight strontium; 0.1-1.0% by weight iron; and the balance aluminum with the alloy being substantially free of copper (e.g. less than 0.20% by weight) and manganese (e.g. less that 0.30% by weight) such that no positive additions of copper are added, but recognizing that impurities to the exemplary levels noted above may exist. 0.40-0.70% by weight magnesium may be added to this embodiment of the alloy. Further, the nickel constituency may be either zero, or 3-6% by weight nickel.

It was unexpectedly found that the above-reference alloys containing 0.03-0.20% by weight strontium result in a hypereutectic aluminum silicon microstructure with highly refined primary silicon particles. Prior to the present invention, the microstructure of hypereutectic aluminum silicon alloys tended to be brittle because phosphorus was required as a nucleus for small primary silicon particle size, and strontium could not be used to modify these eutectic silicon because phosphorus and strontium reacted with one another. Moreover, it was commonly understood that additions of strontium at levels below 0.03% were known to cause the primary silicon particle size to increase, and during machining all of the primary silicon particles would crack and result in very poor castings. The present application surprisingly discovered that if strontium was added in the range of 0.03%-0.20% by weight to a hypereutectic aluminum silicon alloy, almost all of the primary silicon alloy disintegrated into irregular, small primary silicon particles less than 30 microns in size. The resulting castings exhibited over 2% elongation in the as cast condition because both the primary silicon and the eutectic silicon were respectively, and unexpectedly, refined to a small primary silicon particle size and the eutectic silicon was modified to the fibrous morphology from the acicular morphology by the 0.03-0.20% by weight strontium addition. Coupled with these dramatic changes, non-equilibrium primary aluminum dendrites unexpectedly appeared in significant volume fraction in the microstructure with a secondary dendrite spacing [DAS] less than 15 microns. The eutectic structure was so well modified that the eutectic Si and eutectic Al could not be resolved under a microscope at 100× magnification. With the addition of 3-6% by weight nickel, further enhances the machinability of the above referenced alloy.

Turning to FIGS. 4-7, therein is demonstrated the microstructures from 0.5 inch diameter tensile specimens with a 2 inch gauge length that were made in a standard tensile specimen hinged permanent mold. During gravity pouring of molten metal into the mold, the hinged mold is closed, and extracting of the tensile specimen castings was accomplished by opening the hinged mold after the tensile specimen solidified. The cooling rate in this standard tensile specimen permanent mold is estimated to be 29° C./second, about the same as cooling rate in the 100 gram button spectrometer samples of FIGS. 9-10 and 12-16.

Figure 4:
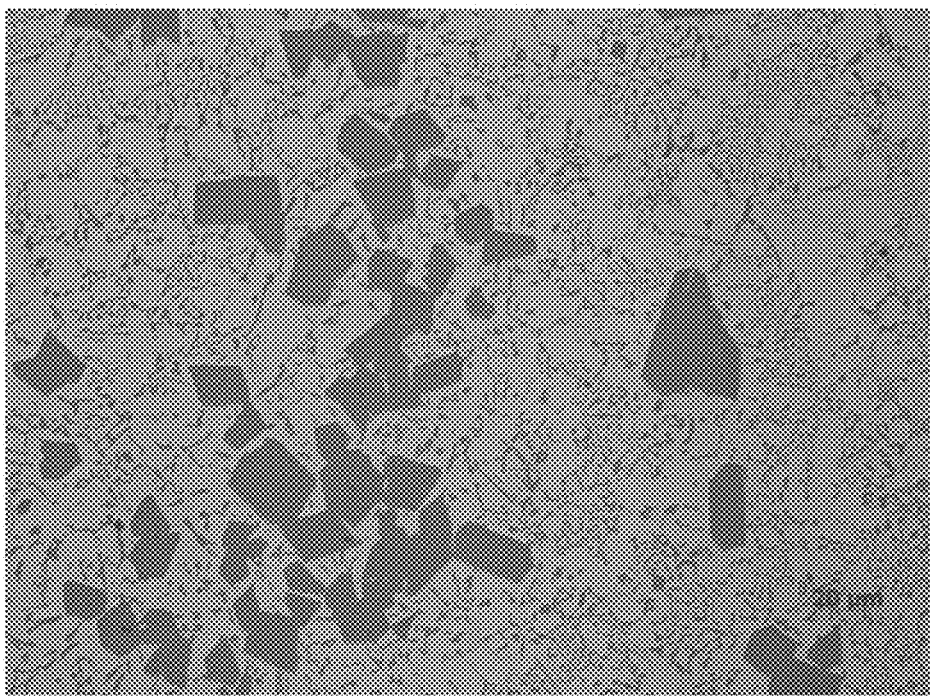
FIG. 4 is the microstructure of an "as cast" phosphorous refined and strontium-free hypereutectic aluminum silicon alloy cast into a permanent mold for tensile specimens.
Figure 5:
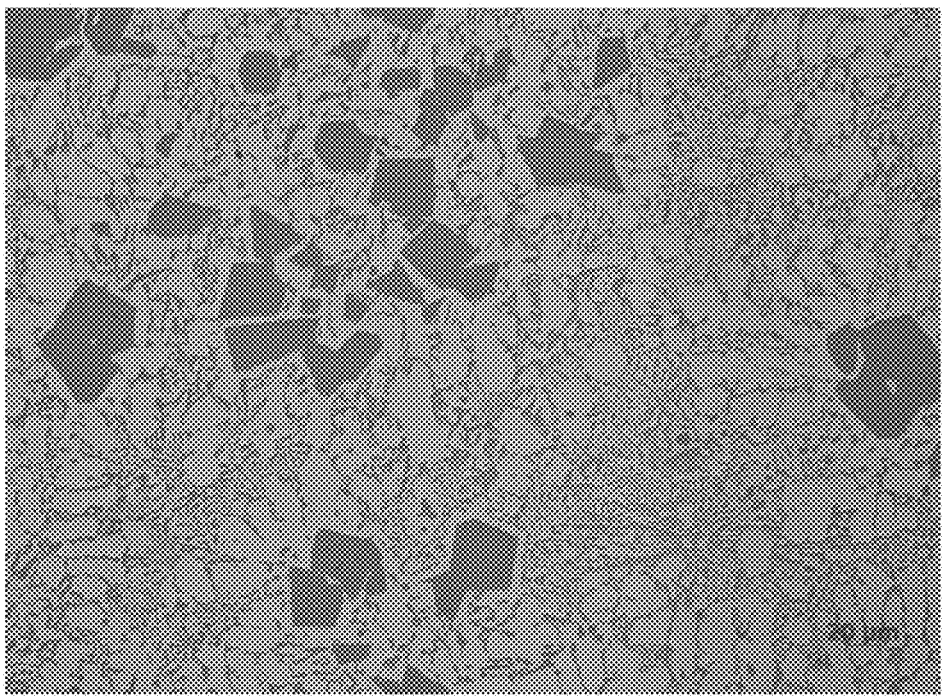
FIG. 5 is the microstructure of an "as cast" phosphorous refined, nickel containing but strontium-free hypereutectic aluminum silicon alloy cast into a permanent mold for tensile specimens.
Figure 6:
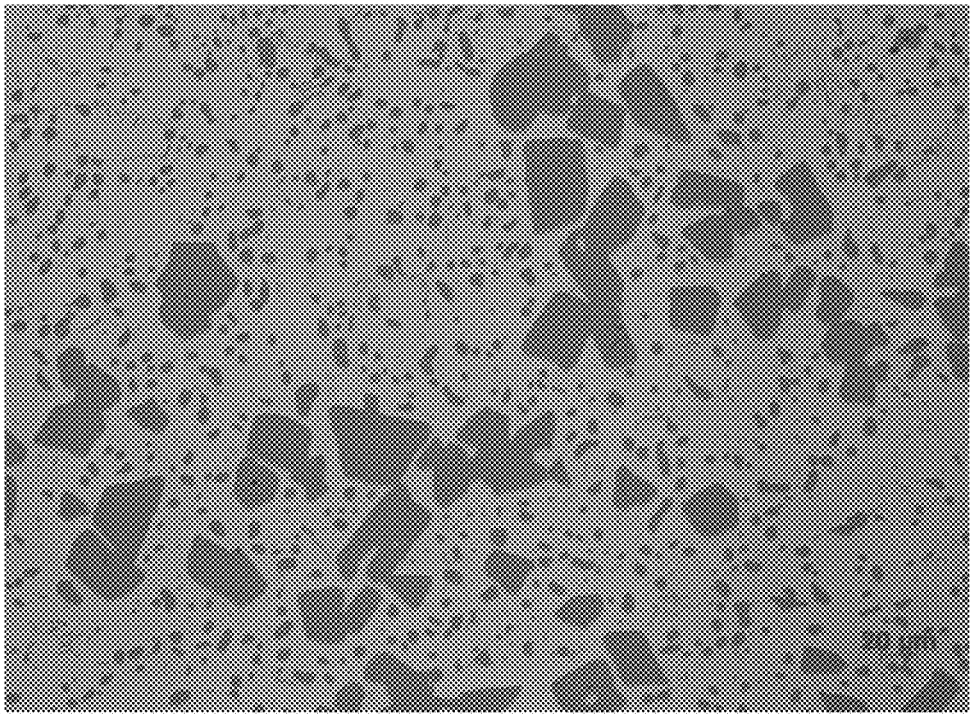
FIG. 6 is the microstructure of a well annealed (100 hours at 1000° F.) "as cast" phosphorous refined and strontium-free hypereutectic aluminum silicon alloy of FIG. 4 cast into a permanent mold for tensile specimens.
Figure 7:
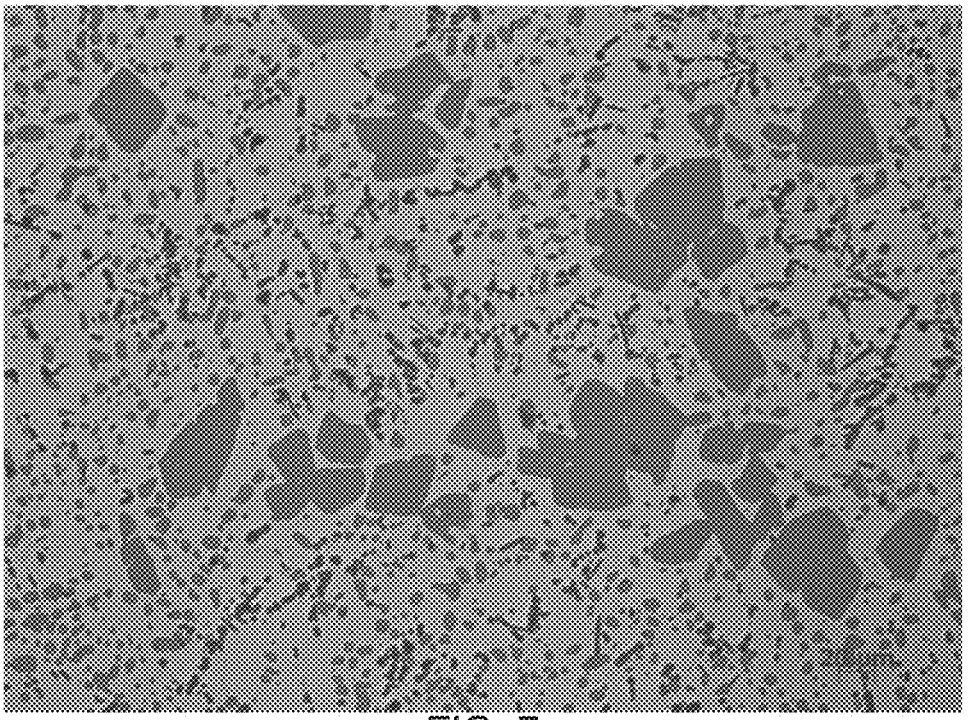
FIG. 7 is the microstructure of a well annealed (100 hours at 1000° F.) "as cast" phosphorous refined nickel containing but strontium-free hypereutectic aluminum silicon alloy of FIG. 5 cast into a permanent mold for tensile specimens.

FIGS. 4-7 are the microstructures of an "as cast" phosphorous refined and strontium-free hypereutectic aluminum silicon alloy cast into a permanent mold for tensile specimens. FIGS. 4 and 6 demonstrate the alloy with the following specific constituency: 20% Si; 1.1% Fe; 0.55% Mg; and substantially free of iron copper and manganese (measured at 0% Fe, 0.08% Cu 0.25% Mn). The difference between the micrographs of FIGS. 4 and 6 is that FIG. 4 demonstrates the "as cast" alloy, while FIG. 6 demonstrates a well annealed alloy after 100 hours at 1000° F. FIGS. 5 and 7 demonstrate the microstructure of the same alloys as FIGS. 4 and 6, but with a 4% nickel addition. Similarly, the difference between the micrographs of FIGS. 5 and 7 is that FIG. 5 demonstrates the "as cast" alloy, while FIG. 7 demonstrates a well annealed alloy after 100 hours at 1000° F. What is common FIGS. 4 through 7 is that the shape morphology of the primary silicon is regular (i.e., the silicon polygons have 4 to six sides), the average primary silicon particle size is about 30 microns because the alloys were phosphorous treated to refine the primary silicon particle size, and the eutectic silicon morphology in the eutectic is acicular or unmodified in the two as cast microstructures. Further, the edges of the primary silicon in the well annealed samples, when compared to the primary silicon in the "as cast" samples, has been rounded by the 100 hours at 1000° F., and this thermal treatment has produced a eutectic silicon that is spherical in shape morphology. The above phosphorous treated microstructures are the baselines that the inventive strontium treated microstructures with be compared to.

The non-nickel alloy of FIG. 4 demonstrated a UTS of 30.0 ksi (or 207 MPa), yield strength of 27.0 ksi (or 186 MPa) and an elongation of 0.5%. The nickel containing alloy of FIGURE. 5 demonstrated a UTS of 32.2 ksi (or 222 MPa), a yield strength of 28.7 ksi (or 198 MPa) and an elongation of 0.5%. At 400° F. (or 205° C.) the yield strength of the nickel free alloy drops to 22 ksi (or 155 MPa) from 27 ksi (or 186 MPa), but the nickel containing alloy did not drop but stayed at 28.0 ksi (or 193 MPa). In the well annealed condition (100 hours at 1000° F.) to thermally produce the optimal elongation shown in FIG. 6 for the nickel free alloy resulted in a UTS of 17.5 ksi (or 121 MPa), yield strength of 12.0 ksi (or 83 MPa) and elongation of 1.7%. The nickel containing alloy of FIG. 7 when well annealed at 100 hours at 1000° F. demonstrated a UTS of 18.0 ksi (or 124 MPa), yield strength of 12.3 ksi (or 85 MPa) and an elongation of 1.7%. Accordingly, the well annealed samples produce an elongation baseline for the inventive strontium containing die casting alloys.

For the high pressure die casting process, a desirable primary silicon size is 20 microns. This desirable microstructure requires the primary silicon to be phosphorous refined. That is, it requires the creation of copious nucleation sites of aluminum phosphide and the fast cooling rate of die casting (i.e., 80 C/sec). A problem arises because strontium phosphide or sodium phosphide compounds are more stable thermodynamically than aluminum phosphide and thus a rapid coarsening of the primary silicon occurs if strontium or sodium is present in the melt in greater concentration than the phosphorous. Moreover, a 50 micron primary silicon particle sized particle generally cracks extensively during machining. Thus, a 25-35 micron particle size in high pressure die casting is the goal.

In FIG. 4, the primary silicon particle size is 20 to 60 microns, with an average of about 30 microns. The eutectic silicon morphology is acicular (or not modified, and thus not fibrous or modified). The 300 ppm phosphorous caused single nucleation of the silicon on each of the many created aluminum phosphide (AlP) particles which resulted in the regular shaped morphology of the primary silicon particles. The coating on the permanent mold die slowed the cooling of the casting compared to the high pressure die casting process resulting in an average primary silicon particle size of about 30 microns and an elongation of 0.5%.

By adding 4% by weight nickel to the alloy of FIG. 4, the microstructure of FIG. 5 is achieved. The primary silicon particles have a blocky regular morphology and the primary silicon particle size is 20 to 60 microns, with an average of about 30 microns. The eutectic silicon morphology is acicular (not modified or fibrous) and the ternary eutectic $NiAl_3$ phase (located mainly in lower right hand corner) is not the primary $NiAl_3$ phase. The phosphorous caused the single nucleation of the silicon on the created AlP particles and the regular shaped particles. Again, the coating on the permanent mold die slows down the cooling of the casting compared to the high pressure die casting process and results in an average primary silicon particle size of about 30 microns and an elongation of 0.5%.

Turing now to FIGS. 6 and 7, the nickel containing alloy in FIG. 7 has significantly smaller eutectic silicon particles than the eutectic silicon particles in the nickel free alloy in FIG. 6. However, even more important is that in FIG. 7 for the nickel containing alloy, the eutectic $NiAl_3$ particles are smaller than the eutectic silicon particles, and much smaller than the eutectic silicon particles in FIG. 6 for the nickel free alloy. This is quite significant microstructural because it is apparent that at 100 hours at 1000° F. the temperature was high enough to break down both the eutectic silicon phase and the eutectic $NiAl_3$ phase and cause growth of the eutectic silicon phase but not the growth of the eutectic $NiAl_3$ phase. As a result, the nickel containing alloys have higher temperature properties.

Figure 3:
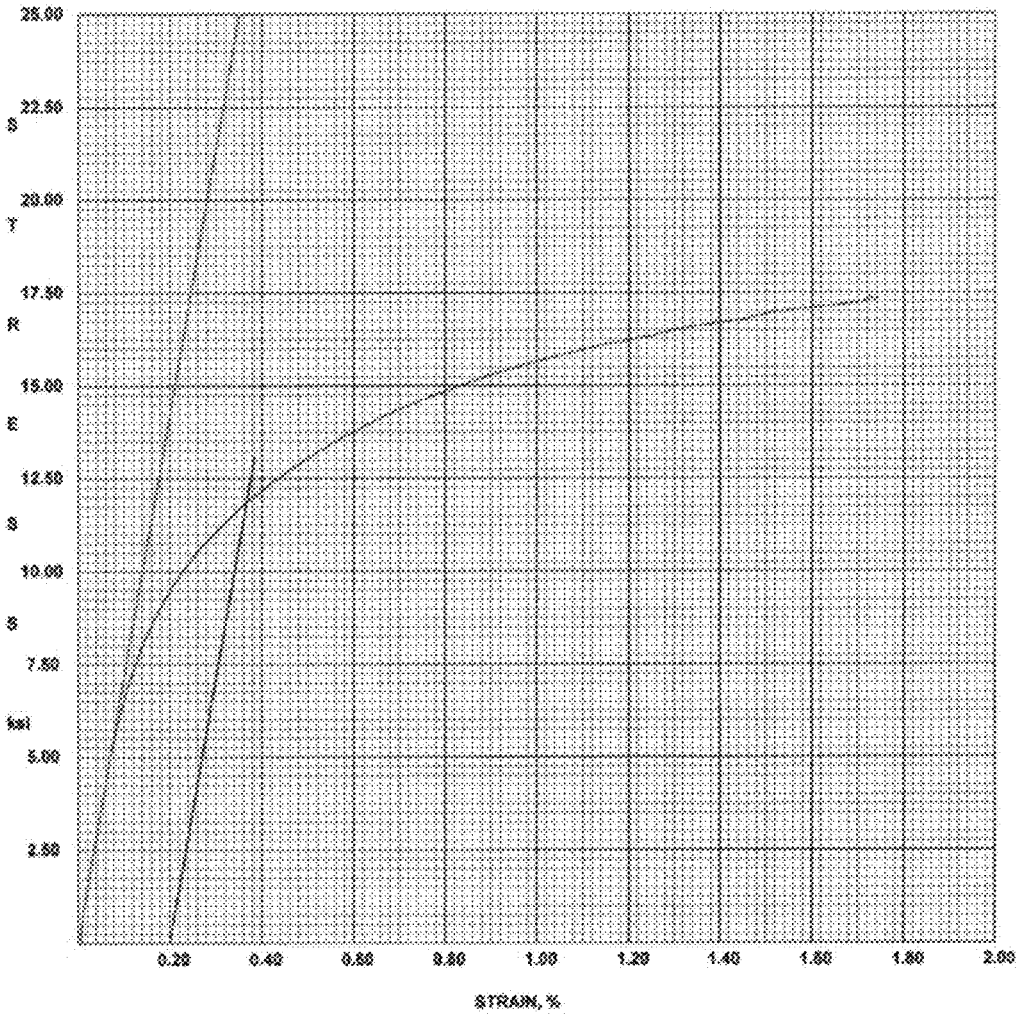
FIG. 3 is a stress/strain curve for a well annealed (100 hours at 1000° F.) hypereutectic Al—Si nickel free alloy.

Throughout this application mechanical properties are reported. FIG. 3 shows a typical chart generated when tensile tests are performed. More specifically, FIG. 3 is the stress strain curve for well annealed (100 hours at 1000° F.) nickel free alloy. The stress in units of ksi is identified on the vertical axis and the strain % is on the horizontal axis. The slope of the red line is the Modulus of Elasticity, and where the slope of the 0.20% off-set blue line intersects the stress strain curve is the yield strength. The stress where the tensile specimen fails is the Ultimate Tensile Strength (or UTS).

There is a further significance in these results in that 100 hours at 1000° F. was more than sufficient to break down the eutectic $NiAl_3$ phase which improves mechanical properties but not sufficient in breaking down the much larger primary $NiAl_3$ phase. Accordingly, the nickel containing alloy of the present application with strontium, and having the ternary eutectic $NiAl_3$ phase in the microstructure but no primary $NiAl_3$ phase in the microstructure, has significant potential for use in many different types of castings.

Further unexpected results occurred when strontium in the range of 0.03 to 0.2% by weight was added to the alloys. FIG. 8 demonstrates the "as cast" microstructure of tensile specimens extracted from a cast engine block having the following specific constituencies: 19.2% by weight Si; 0.05% by weight Sr; 0.7% by weight Fe; and 0.46% by weight Mg, with the balance aluminum. The alloy was substantially free of copper and manganese (measured at 0.09% Cu and 0.24% Mn) and only an incidental amount of nickel was found at 0.05% by weight Ni. Testing of three specimens from this casting revealed an average UTS of 38.1 ksi (263 MPa), a yield strength of 30.0 ksi (207 MPa) and an elongation of 2.1%, which is four times the elongation of a typical hypereutectic Al—Si alloy of 0.5%, and longer than the elongation of a well annealed conventional hypereutectic Al—Si alloy.

In FIG. 8, the form of the primary silicon is unexpectedly not "regular" but smaller and irregular, presenting the opportunity for better machining because the primary silicon is refined and small in size, with an average size less than 10 microns or smaller than the better than best results expected in conventional phosphorous refined primary silicon in high pressure die casting. Further, there is a large fraction of primary silicon for high wear resistance. Moreover, the eutectic is unexpectedly modified most likely through a very large undercooling that produces a secondary dendrite arm spacing (SDAS) of 10 microns or less for the primary aluminum dendrites along with a significant higher volume fraction of primary aluminum dendrites and fibrous modified eutectic silicon that cannot be resolved in the eutectic between the clusters of disintegrated primary silicon particles.

Typically, the primary silicon phase of hypereutectic Al—Si alloys is not readily nucleated by impurities present in these alloys. As a result, phosphorous is added to hypereutectic Al—Si alloy melts in permanent mold casting, and very frequently in die casting for nucleation. As noted above, the phosphorous (in amounts of about 100 to 500 ppm) reacts with the liquid aluminum to form AlP, which has a crystal structure very similar to that of silicon, and acts as an effective heterogeneous nucleant. Strontium phosphide and sodium phosphide, however, are compounds that are more stable than aluminum phosphide and therefore a coarsening of the primary silicon is expected when strontium or sodium is added to the melt.

The microstructure in FIG. 9 illustrates the accepted scientific logic of this reasoning (i.e., adding strontium increases the primary silicon size). By adding 0.016% strontium, the primary silicon size tripled in size. FIG. 9 demonstrates that under 0.03% by weight strontium, the hypereutectic alloy has the regular blocky primary silicon particles size morphology of 90 microns in size. As shown in FIG. 9, strontium levels typical of those required to cause modification in hypoeutectic alloys like A356 coarsen the primary silicon, but the primary silicon retains its blocky regular shape morphology. Compared to the phosphorous refined primary silicon size of 30 microns produced in FIGS. 4-7 with 0% strontium that exhibited no chemical modifications of the eutectic silicon, at 0.016% strontium, modification of the eutectic silicon phase is effected, and the primary silicon morphology retains its blocky regular shape morphology, but a big price is paid, the primary silicon size here is three times larger at 90 microns and the elongation is still 0.5% or less. Indeed, adding strontium from 0.001% to just below 0.03% increases the size of the primary silicon particles, as shown in FIG. 9. Thus, one of ordinary skill in the art would expect the primary silicon size to continue to increase as the strontium addition is increased. However, what was surprisingly found, and what is demonstrated in FIGS. 8, 10 and 12-16 is that when strontium is added at 0.03% by weight and above, the primary silicon fragments and disintegrates, as if it exploded, to a smaller primary silicon particle size with an irregular shape morphology and the eutectic silicon is modified.

As seen in FIG. 8, with the strontium addition of 0.05 to 0.2% by weight, the micrograph exhibits a microstructure with a refined primary silicon particle size less than 15 microns. This is almost half the best silicon particle size produced in conventional die casting with phosphorous refinement of the primary silicon. Unlike the microstructure in FIG. 9 with strontium at 0.016%, the microstructure in FIG. 8, demonstrates individual starting primary silicon particle appears to be fragmented into four or five smaller pieces of less than 15 microns. Moreover, the alloys of the present invention demonstrate a modified eutectic with the eutectic silicon morphology that is fibrous in nature. The combination of both a refined primary silicon and a modified eutectic silicon has not been exhibited in production castings heretofore and is responsible for elongations in production parts that exceed 2% elongation, i.e., four times the elongation of strontium-free conventional hypereutectic Al—Si alloys.

Further, in a typical hypereutectic 391 alloy with 18-20% silicon, the equilibrium weight fraction of alloy that freezes as eutectic is approximately 91%. This is much greater than the approximately 9% that solidifies as primary silicon. With the present invention, modification of the eutectic silicon in the eutectic with strontium affects considerably more of the micro-constituent representing 91% of the alloy weight than does primary silicon refinement with phosphorus which represents 9% of the alloy weight. This 10 to 1 ratio driving the modification of the eutectic silicon in the eutectic, at least as far as the tensile properties are concerned, can more than compensate for the expected considerable coarsening of the primary silicon phase. Significant increase in UTS (25%), yield strength (10%), elongation (400%) and quality index (250%) were found by the inventors when the eutectic silicon is modified in accordance with the present invention. One of skill in the art will recognize, however, that machinability becomes more of a problem with a coarse primary silicon, if the die casting process is not used, and if the 4% nickel alloy, having the ternary eutectic $NiAl_3$ phase, is not used.

FIGS. 10 and 12-16 also demonstrate visible eutectic cells because the cell boundaries appear to be decorated with sub-micron sized $Al_4Sr$ particles. The smallest eutectic cell size is about 65 microns and the largest about 200 microns, while the average is about 100 microns. In the ever changing eutectic modification theory, the currently accepted theory is that eutectic silicon modification is accompanied by a tenfold increase in the cell size for hypoeutectic Al—Si alloys, according to S. D. McDonald in his Ph.D. thesis from University of Queensland, Brisbane, Australia, July, 2002. However, this cell size can only be seen in hypoeutectic Al—Si—Cu[—Fe] alloys wherein the cell boundaries are decorated with either the $CuAl_2$ phase or beta platelets of the $Al_5FeSi$ phase. Thus, the accepted theory of modification of hypoeutectic Al—Si alloys never mentioned the eutectic cell size in any technical explanation until 2002 because evidence of the cell size was never observed until 2002, and only after the development of very special techniques to see eutectic cell grains in Al—Si alloys. As the ternary phase diagram for the Al—Si—Fe system shown in FIG. 11 indicates, beta (β) phase platelets of the $Al_5FeSi$ phase in hypoeutectic Al—Si—Fe alloys can be explained if the iron is 1% or higher and the silicon is 13%, but it is impossible for them to form in the higher silicon hypereutectic alloys. The ternary phase diagram suggests that the delta (δ) iron phase might precipitate in Al—Si with more than 14% or higher Si but this has never been reported. The phase diagram of FIG. 11 indicates that at 1% Fe and 14% Si, the β iron $Al_5FeSi$ and the δ iron phase cannot form if the iron is less than 1%. This suggests that the phase that decorates the eutectic cells is $Al_4Sr$, by a process of elimination.

Visible eutectic cells in the permanent mold cast specimens are mentioned because no special technique was used to see the eutectic cells in FIGS. 10 and 12-16. The microstructures are simply polished samples with no enchant required. It is believed that the small species that very clearly decorate eutectic cell boundaries in FIGS. 10 and 12-16 are most probably the $Al_4Sr$ phase particles. Further, the eutectic cells are clearly seen in these figures are samples with more than 0.03% strontium cooled at 29 C/sec, and are associated with the small broken up irregularly shaped silicon particles and a modified eutectic structure. However, two important observations are apparent when compared to FIG. 8. First, there is an absence of undercooling, non-equilibrium primary aluminum phase in FIG. 10. Second, there is the absence of the very small primary silicon phase (in FIGS. 10 and 12-16), which clearly are visible in the FIG. 8 microstructure of the high pressure die cast block that cooled at 60 or more ° C. per second, more than twice the cooling rate of the button spectrometer samples. On closer examination of the high pressure die cast microstructure in FIG. 8 compared to the permanent mold microstructure in FIG. 9 or 10 and 12-16, is the absence of what is believed to be the $Al_4Sr$ phase in FIG. 8 and presents in the other cited figures, suggesting the high pressure die casting cooling rate is needed to suppress the precipitation of the speculated $Al_4Sr$ phase. At the lower cooling rates of sand casting, the microstructure of the button spectrometer sample containing 0.03% Sr or more have the large dendritic morphology of the primary silicon particles seen in FIGS. 10 and 12-16, whereas FIG. 8 has small irregular shaped primary silicon particles, further suggesting the cited microstructures are cooling rate dependent, and the die casting cooling rate produces the preferred microstructure.

For specificity, the particular constituencies of the hypereutectic aluminum silicon alloys shown in FIGS. 8-10 and 12-16 are provided in Table 1, below. Note that the constituencies represent positive additions to the alloys, rather than impurities from the stock metals. Further, all alloys contain Aluminum as the balance constituency.

| FIG. | % Silicon | % Strontium | % Nickel | % Magnesium | % Iron | Impurities |
|---|---|---|---|---|---|---|
| 8 | 19.2 | 0.050 | 0 | 0.46 | 0.7 | 0.09 Cu, 0.24 Mn, 0.05 Ni |
| 9 | 18.5 | 0.016 | 0 | 0.59 | 0.6 | 0.17 Cu, 0.19 Mn, 0.02 Ni |
| 10 | 18.4 | 0.030 | 0 | 0.59 | 0.6 | 0.17 Cu, 0.18 Mn, 0.01 Ni |
| 12 | 18.4 | 0.040 | 0 | 0.58 | 0.6 | 0.16 Cu, 0.19 Mn, 0.01 Ni |
| 13 | 18.5 | 0.060 | 0 | 0.57 | 0.6 | 0.17 Cu, 0.18 Mn, 0.01 Ni |
| 14 | 18.4 | 0.090 | 0 | 0.57 | 0.6 | 0.16 Cu, 0.18 Mn, 0.01 Ni |
| 15 | 18.5 | 0.18 | 0 | 0.57 | 0.6 | 0.16 Cu, 0.19 Mn, 0.01 Ni |
| 16 | 18.5 | 0.05 | 4.3 | 0.56 | 0.6 | 0.16 Cu, 0.18 Mn, |
| 18 | 20.4 | 0.022 | 0 | 0.65 | 0.26 | 0.07 Cu 0.04 Mn |

The results of the alloy made in accordance with the present invention is a complex microstructure with a majority of the primary silicon particles with a particle size of less than 15 microns. Moreover, the eutectic structure is modified, with the primary aluminum phase in the microstructure with a secondary dendrite arm spacing of less than 15 microns. Further, the primary silicon volume fraction is about 20% (twice that found in normal hypereutectic Al—Si alloys) and these primary silicon particles are surrounded by a divorced eutectic aluminum. The modified eutectic surrounds the primary aluminum dendrites. The volume fraction of primary aluminum dendrites, including the modified eutectic that surrounds the primary aluminum, is larger than the volume fraction of the primary silicon including the divorced eutectic aluminum that surrounds the primary silicon, and the secondary dendrite arm spacing of the aluminum is larger than the primary silicon particle size. The alloys of the present invention also have an elongation of 2.1% for the "as cast" sample of FIG. 8, and this is four times the typical elongation of 0.5% in "as cast" conventional hypereutectic Al—Si alloys. This elongation is also higher than the elongation that can be obtained in well annealed conventional hypereutectic Al—Si alloys. At higher temperatures, e.g., 400° F., the nickel containing alloy has higher mechanical properties.

The alloy of the present invention may have a T6 heat treated microstructure of primary silicon particles embedded in a eutectic of Al—Si or Al—Si—$NiAl_3$ and is generally free of unsolutionized $Mg_2Si$ phases and $Cu_3NiAl_6$ in Chinese script compacted blocky morphology form. The hypereutectic aluminum silicon alloy of the present invention has an anticipated use with a die casting process to cast engine components such as engine blocks, engine heads and pistons, particularly when such components are to be used in salt water where high corrosion resistance is required. The alloy in the present invention provides high mechanical properties (through low porosity levels) both at ambient temperatures and at elevated temperatures.

Achieving high corrosion resistance and low porosity levels necessitates an alloy composition low in copper content. Copper is extensively soluble in aluminum, reaching 5.65% at the binary Al—Si eutectic temperature and, as a result, copper destroys the corrosion resistance of aluminum to a greater extent than any other common element in the periodic table. Aluminum silicon alloys containing copper precipitate the copper containing phases at low temperatures late in the solidification process after the precipitation of the primary aluminum phase. This low temperature, late precipitation event clogs the interdendritic feed passageways created by the primary aluminum silicon dendritic. As a result, the copper containing aluminum silicon alloys cast with the lost foam casting process of U.S. Pat. No. 6,763,876 typically contain ten times the level of porosity that can be obtained with the copper free aluminum silicon alloys.

The present invention describes system engineered design changes based on the introduction of the $NiAl_3$ phase into an aluminum silicon eutectic microstructure. These design changes provide partitions in the aluminum silicon eutectic that increase machinability and provide an intermetallic compound constituent in the eutectic having greater galvanic couple compatibility in a salt water environment than with aluminum-nickel or aluminum-silicon.

Clogging of the interdendritic passageways for alloys with high iron constituencies (e.g., AA 336 and AA 393) may occur because the iron phase forms long, needle like phases during solidification, clogging the interdendritic passageways and causing the alloy to have high microporosity. In contrast, the "Chinese script" compacted, blocky phase morphology of an $NiAl_3$ eutectic phase is blocky but compacted and intermixed with aluminum silicon eutectic when formed under die casting cooling rates in the ternary reaction ($Liq>Si+Al+NiAl_3$). Significantly, the coarse $NiAl_3$ primary phase starts to precipitate, particularly for Ni compositions above 6%, before the ternary eutectic temperature is reached. Thus, nickel contents above 6% should be avoided if mechanical properties, and in particular ductility, is important. The $NiAl_3$ network in the ternary eutectic, because of its open structure at the micron level, is quite permeable for the liquid constituents that do not contain solid copper phases or solid iron phases and thus, this morphology does not hinder the interdendritic feeding of molten aluminum. As a result, hypereutectic aluminum-silicon alloys containing nickel, but having low levels of both iron and copper, have lower porosity levels, when high pressure die cast with pressure intensification.

During solution heat treating of "as cast" samples, there is a clear difference between copper containing hypereutectic aluminum silicon alloys with nickel and copper free hypereutectic aluminum silicon alloys with nickel. Solution heat treating solubilizes $Mg_2Si$ and most of the $Cu_3NiAl_6$ phase, but only causes simple rounding of the silicon and $NiAl_3$ particles, as seen in FIGS. 6 and 7. The phenomenon occurs because silicon and $NiAl_3$ are basically insoluble in aluminum, while magnesium and copper are extensively soluble in aluminum. Thus, results suggest that silicon and $NiAl_3$ should provide strength and stability at elevated temperatures to a greater extent than magnesium, copper and manganese. The results also suggest that microstructures obtained with the copper free aluminum silicon alloys containing nickel are relatively stable at room temperatures after slow cooling through the solidification event, because no non-equilibrium phases form. Fast cooled samples, on the other hand, because of the possible presents of non-equilibrium phases (such as, primary aluminum dendrites in a hypereutectic aluminum-silicon alloy, as in FIG. 8), might be expected to have microstructures that have unique advantages at room temperatures, and if nickel is a constituent in the non-equilibrium phase, that phase may have stability at an elevated temperature also.

Additionally, it has been realized that when nickel is added to the eutectic constituents as an $NiAl_3$ compound rather than as a pure element (that is insoluble in aluminum), there is no uncombined nickel (i.e., "free nickel") present in the microstructure. This is significant because free nickel affects galvanic corrosion phenomena adversely, while $NiAl_3$, as aforementioned, has beneficial effect of facilitating corrosion resistance.

It is known that in man-made metal matrix composites, the volume fraction of the reinforcing phase is increased by artificially adding more of the reinforcing phase. With eutectics, the volume fraction of the reinforcing phase (i.e., the "fiber phase") and the matrix phase are fixed by nature by the eutectic composition and by the compositions of the phases in equilibrium at the eutectic temperature.

The AA B391 alloy is associated with a binary Al—Si eutectic that has a long arrest temperature isotherm at 577° Celsius. The long arrest isotherm allows liquid styrene to escape when cast in the lost foam casting process, which has the effect that it is less likely that liquid styrene defects will be in lost foam castings. In the present invention, particularly with nickel, under equilibrium conditions there should be only one arrest temperature, and that is the ternary eutectic temperature of the Al—Si—$NiAl_3$ at 557° C. for the 5% Ni alloy, 20° C. below the Al—Si eutectic temperature. However, under the non-equilibrium cooling conditions of high pressure die casting, the arrest temperatures of the Al—Si eutectic at 577° C. and of the Al—Ni eutectic at 640° C. may also come into play. Thus the microstructure in FIG. 8. In the present invention, the non-equilibrium arrest temperatures are expected to enhance feeding of shrinkage porosity. Copper containing aluminum silicon alloys with nickel, in addition to the above, would also contain the $Cu_3NiAl6$ phase in Chinese script compacted blocky form that would aid in machinability but would contain low melting copper phases that precipitate late in the solidification process and clog the feed passageways, preventing the attainment of low porosity levels. Thus, the inventive alloy must be low, and preferably substantially free, of copper.

The copper free hypereutectic aluminum silicon alloys, with a solidus melting point of nearly 100° Fahrenheit higher than the copper containing hypereutectic aluminum silicon alloys, do not precipitate low melting point phases that clog the interdendritic passageways feeding this shrinkage porosity. Thus, the coarse Chinese script morphology of the $NiAl_3$ phase in the Al—$NiAl_3$ eutectic, when solidified under sand casting cooling rates, enhances the feeding of shrinkage porosity because of the $NiAl_3$ size and morphology relative to the eutectic silicon phase.

The present invention utilizes the Al—$NiAl_3$ binary eutectic as it extends with increasing silicon content into the bivariant (i.e., two degrees of freedom) temperature plane of the Al—$AlNi_3$—Si phase diagram, to provide a source of the $NiAl_3$ phase in "Chinese script" compacted blocky morphology form with a 14% $NiAl_3$ for 6% nickel composition.

Accordingly, the $NiAl_3$ is preferably introduced into the eutectic and does not materially change the initial primary silicon volume fraction. Further, the $NiAl_3$ addition imparts high wear properties because long tie lines from essentially pure silicon to the Al—Si eutectic equilibrium remain relatively constant. However, the $NiAl_3$ addition increases the volume fraction of the eutectic constituents, and accordingly, less Al—Si eutectic must freeze at the lowest temperatures. This is advantageous in the present invention because, compared to a normal binary eutectic, all of the solidification does not have to occur at one temperature. Accordingly, there is a lengthened time frame with an organized sequence of solidification events over a range of temperatures. The job of "feeding" shrinkage (e.g., with the pressure intensification of high pressure die casting) is improved. This is beneficial to the quality of the casting as defects are reduced. Accordingly, because the alloy of the present invention, with the $NiAl_3$ compound addition creating either a binary Al—$NiAl_3$ eutectic equilibrium or a ternary Al—Si—$NiAl_3$ eutectic that occur at a higher temperature than the Al—Si eutectic, effectively the temperature of the eutectic is raised and the viscosity of the melt is increased by 10 to 15%.

Thermodynamically, the heat fusion of aluminum is quite high at 92.7 calories per gram, while the heat of fusion of $NiAl_3$ is 68.4 calories per gram. However, the heat of fusion of silicon is much higher at 430 calories per gram, nearly five times that of aluminum and over six times that of $NiAl_3$. Thus, as a nickel free hypoeutectic aluminum silicon alloy solidifies and gives off 430 calories per gram as the primary silicon precipitates, there is a tendency for the temperature gradient on the aluminum to decrease. The decrease of the temperature gradient of the aluminum reduces the heat input to the melt and causes shrinkage porosity to become more difficult to feed. Thus, nickel containing Al—Si alloys should feed porosity better than nickel-free Al—Si alloys.

In contrast, as the hypereutectic aluminum silicon alloy of the present invention solidifies and $NiAl_3$ precipitates out of solution, only 68.4 calories per gram of heat are given off. Thus, during this early stage of solidification when $NiAl_3$ is precipitating out of the solution, a larger temperature gradient is expected and, as a result, the feeding efficiency of the shrinkage porosity is greater than when compared to an alloy without nickel. The addition of the $NiAl_3$ compound thus provides favorable conditions for decreasing the amount of eutectic liquid that will have to go through the Al—Si eutectic during the last stages of solidification for the alloy, and further increasing shrinkage porosity feeding efficiency.

One embodiment of the present invention sets an upper limit of 6% nickel. Higher values of nickel would involve the $NiAl_3$ phase not only as a phase solely coming from the Al—$NiAl_3$ eutectic, but also as a primary phase. This would involve a liquidus temperature steeply rising with increasing nickel content and a temperature above the melting point of pure aluminum all of which works against the attributes needed for a good casting alloy. At 6% nickel, the binary $NiAl_3$ eutectic reaction produces a eutectic that is 14.3% $NiAl_3$. This is the maximum amount of eutectic $NiAl_3$ that can be obtained; it is fixed by nature. At 3% nickel, only half of the 14.3% $NiAl_3$ is obtained. At 2% nickel, only ⅓ of the $NiAl_3$ is obtained. Thus, for practical reasons, 3% by weight nickel was chosen as the lower limit because of the diminishing benefits in going to lower nickel concentrations. Furthermore, there is both a machining and high temperature strength advantage of having a volume fraction of the $NiAl_3$ phase that exceeds the primary silicon volume fraction. This is more likely to be seen for nickel contents greater than 4.5% by weight.

As aforementioned, the nickel containing alloy of the present invention is primarily intended for the high pressure die casting processes where the iron content is low and the manganese content is low and die soldering resistance is provided by the strontium. For those casting processes where the iron content may be above 0.2%, and in particular above 0.3% by weight, cobalt up to 2% by weight, preferably only up to 1% by weight, may be substituted for an equivalent amount of nickel. The advantage of such substitution is that the cobalt modifies the needle like morphology of the aluminum beta phase.

Magnesium is present in the alloy of the present invention for its age hardening response. Under the conditions of equilibrium for hypereutectic aluminum silicon alloys, $Mg_2Si$ does not appear visible at less than 2000× magnification in the as cast condition as a coarse constituent of the eutectic until a magnesium content of about 0.75% has been attained. Also, when the magnesium level is kept below 0.75%, aluminum, silicon and $Mg_2Si$ form a ternary eutectic containing 4.97% magnesium, and 12.95% silicon and freezes at 555° Celsius.

Silicon is present in the proposed alloy for the wear resistance properties imparted by the hard primary silicon particles. Compared to the standard AA 390 alloy which can have a silicon content as low as 16% by weight, the proposed alloy has a minimum silicon content of 18% by weight. Accordingly, this silicon level contains 50% more primary silicon for wear resistance. Silicon levels higher than 20% by weight will contain 100% more primary silicon particles than a 16% by weight silicon alloy, but are not advised because the liquidus is above 700° Celsius.

The electrolytic potential of the $NiAl_3$ compound is negative 0.73 volts, as compared with negative 0.85 volts for pure aluminum. The potential of aluminum-nickel alloys decreases slowly from pure aluminum to $NiAl_3$. Metals with large positive standard electrode potentials (e.g., Au, Ag, Cu) show very little tendency to dissolve in water and are known as noble metals. However, base metals with a negative standard electrode potential have a tendency to dissolve in water or corrode, such as magnesium and sodium. Thus, a galvanic couple between aluminum and $NiAl_3$ shows a slight tendency of the less noble aluminum metal in the system to dissolve in the electrolyte. The galvanic corrosion of aluminum coupled to pure nickel would be expected to be far worse because nickel is significantly more noble than $NiAl_3$. Thus, since the nickel is entirely tied up in the $NiAl_3$ compound, the addition of nickel to the alloy does not decrease the alloy's application for salt water use. In fact, the potential difference for the Al—$NiAl_3$ couple in salt water is less than the potential difference for the Al—Si couple in salt water.

Pistons are the engine components that require the highest elevated temperature properties. A low thermal expansion coefficient is of paramount importance in selecting a material for piston construction. Nickel decreases the thermal expansion coefficient of aluminum to a greater extent than any other element and, at a 6% nickel addition, the thermal expansion coefficient of aluminum decreases by approximately 10%. High thermal conductivity is also a very important property for piston construction because the combustion heat of the engine must be dissipated. However, elements that dissolve in aluminum in the solid state solution affect the lattice structure and decrease the thermal conductivity of aluminum. Accordingly, heat treating procedures that cause the precipitation of phases from solution in aluminum, such as the T5 heat treatment versus the T6 heat treatment, is the appropriate heat treatment for an aluminum piston alloy.

It is known that nickel is insoluble in aluminum in the solid state. Nickel has no measurable effect on the thermal conductivity of aluminum because the maximum solubility of nickel and aluminum is approximately 0.04%. Nickel forms a eutectic with aluminum at the aluminum end of the Al—Ni binary diagram. The Al—Ni eutectic requires a liquid alloy of approximately 6% by weight nickel to decompose at 640° Celsius on cooling to a mechanical mixture of basically "pure" solid aluminum and $NiAl_3$. This solidified alloy has a density of approximately 2879 kg/m3. This density is less than the expected algebraic calculated density of 3072 kg/m3 for a 6% addition of nickel because the $NiAl_3$ expands upon solidification.

Figure 1:
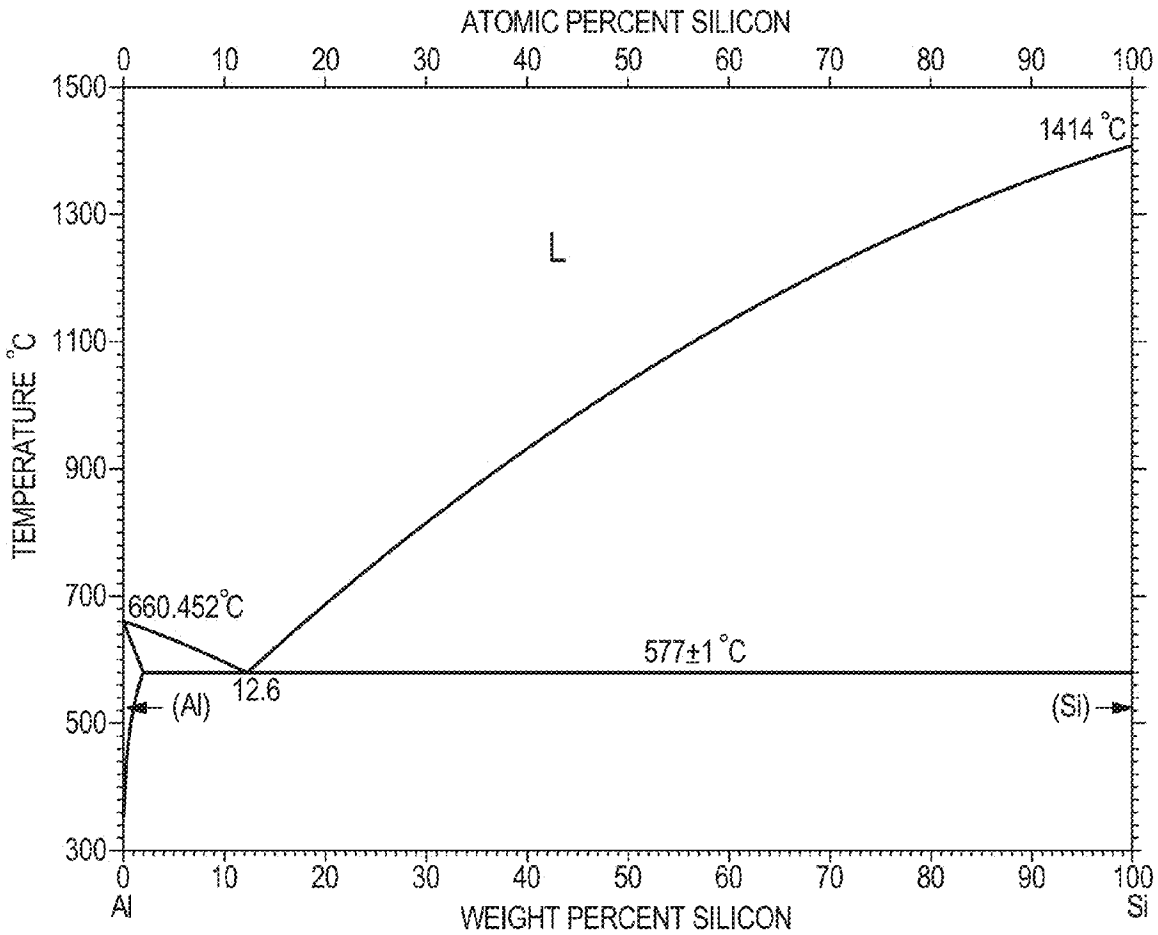
Figure 2:
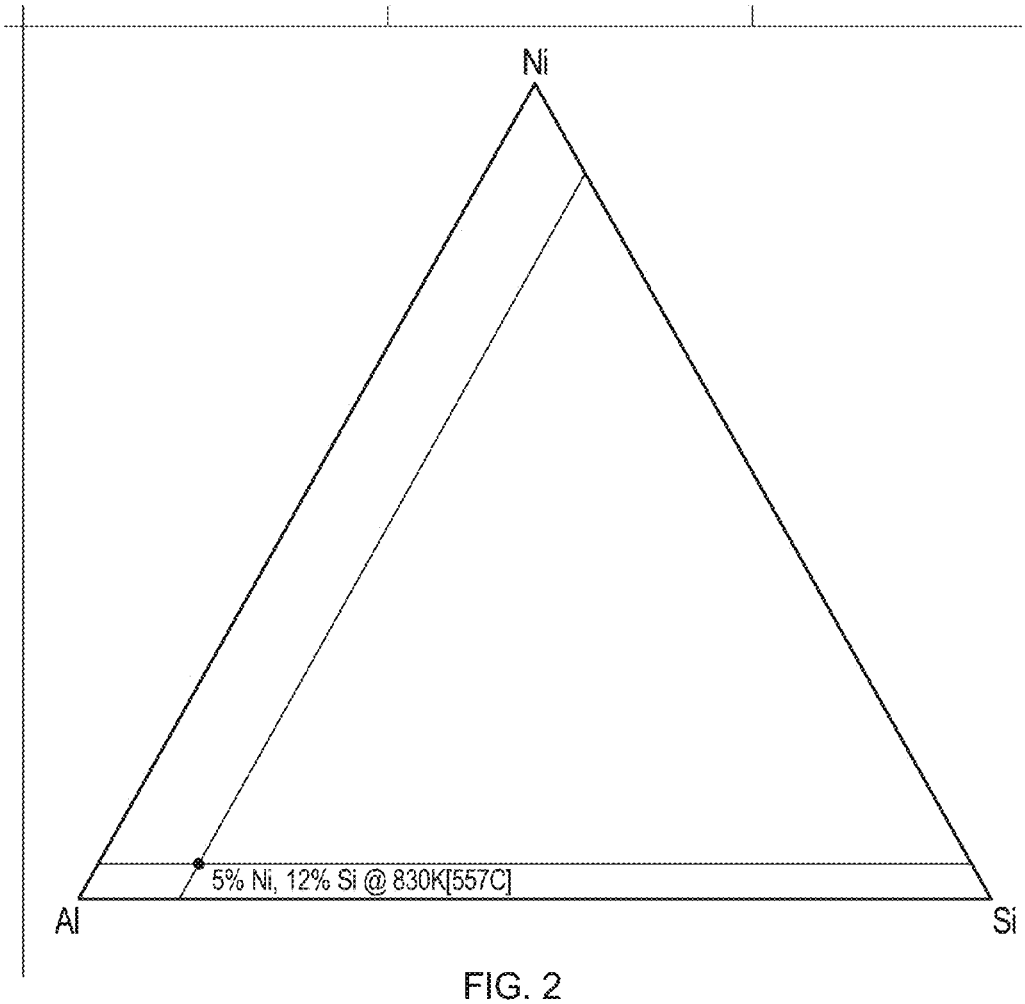
FIG. 2 is a ternary diagram for a three phase equilibrium for the Al—Si—$NiAl_3$ ternary system.

Referring now to the Al—Si phase diagram of FIG. 1 and the Al—Ni binary phase diagram of FIG. 19, although a phase equilibrium diagram for the Al—Si—$NiAl_3$ ternary system does not exist, it will be recognized by those skilled in the art that a ternary eutectic transformation liquid >Al+$NiAl_3$+Si occurs at approximately 5% Ni, 11-12% Si at 557° C. In the solid state the three phases Al, $NiAl_3$, and Si are present in most of the alloys. The solubility of silicon in $NiAl_3$ is of the order of 0.4-0.5%; the solubility of nickel in aluminum is only 0.04% at the binary eutectic temperature and that of silicon is reduced by nickel additions. This knowledge, combined with the Al—SI phase diagram of FIG. 1 and the Al—Ni phase diagram of FIG. 19 demonstrates that there is a three phase equilibrium for the Al—Si—$NiAl_3$ ternary system. Thus, a ternary diagram may be constructed demonstrating that equilibrium occurs over a temperature range and not, as in binary systems, at a single temperature, as demonstrated in FIG. 2. According to the Gibbs' Phase Rule, the three phase equilibrium in the ternary system is bivariant. The Gibbs' Phase Rule states that the maximum number of phases (P) that can coexist in a chemical system or alloy, plus the number of degrees of freedom (F) is equal to the sum of the components (C) of the system plus 2. Thus, in the Al—Si—$NiAl_3$ equilibrium, two degrees of freedom exists because there is a maximum number of 3 phases that can coexist and 3 components of the system exist since $F=(C+2)-P$ according to the Gibbs' Phase Rule. Accordingly, after the pressure has been selected, only the temperature or one concentration parameter need be selected in order to fix the conditions of equilibrium.

The representation of a three-phase equilibrium on a phase diagram requires the use of a structural unit that will designate, at a given temperature, the fixed composition of three conjugate phases (i.e., the Al phase, the Si phase and the $NiAl_3$ phase). The structural unit is found in the "tie triangle" of FIG. 2, where R represents the Al phase, S represents the $NiAl_3$ phase and L represents the Si phase. The triangle R—S-L connects the three phases that the original phase P decomposes into. Using P as the experimental condition 20% Si, 6% Ni and approximately 73% Al, and using the formulas, tabulated in FIG. 2, to calculate the percentage of $NiAl_3$ and percentage of silicon, the percentage of $NiAl_3$ is determined to be 11% and the percentage of silicon is determined to be 8%. These calculations are in reasonable agreement (i.e., + or −1% for $NiAl_3$ and + or −0.5% for silicon) with quantitative metallography that was measured on ten samples.

It has been observed that the $NiAl_3$ phase precipitates out of the high pressure die casting alloy at about a 14% quantity as a semi-continuous mass of "Chinese script" compacted blocky phases in the eutectic structure between primary silicon particles and primary aluminum dendrites. Meanwhile, the primary silicon volume fraction is approximately 8% in typical sand cast microstructure. This unique microstructure is particularly important for improved machinability and further provides the appropriate reinforcement for elevated temperature creep strength and other elevated temperature properties, making the alloys of the present invention an excellent choice of material for piston construction.

In another embodiment of the present invention, a hypereutectic aluminum silicon high pressure die cast alloys is disclosed herein having 16% to 23% by weight silicon, 0.01% to 1.5% by weight iron, 0.01% to 0.6% by weight manganese, 0.01% to 1.3% by weight magnesium, 0.05% to 0.20% by weight strontium and the balance aluminum is disclosed. This alloy may also include 0.01% to 4.5% by weight nickel, but the nickel constituency may also be excluded. The iron constituency may me modified to 0.01% to 0.7% by weight iron, or 0.01% to 0.2% by weight iron. The manganese constituency may be modified to 0.01% to 0.5% by weight manganese. The strontium constituency may be modified to 0.05% to 0.1% by weight strontium. This embodiment, when cooled at high pressure die casting cooling rates, demonstrates significant structural and microstructural advantages.

Alloys of this embodiment are substantially free of copper, and thus have a higher solidus temperature and a narrower solidification range than copper-containing hypereutectic Al—Si alloys like AA390 and AA392. This contributes to a more uniform distribution of the primary silicon and improved wear resistance. The higher solidus temperature of the alloys of this embodiment is approximately 85° F. higher than the copper-containing alloys. Alloys of this embodiment exhibit over 2% elongation. In comparison, AA390 and AA392 exhibit elongations of 0.5%, due to a relatively large primary silicon particle size and an unmodified eutectic. AA390 and AA392 are used in the manufacture of linerless all-aluminum engine blocks. However, these alloys are also used in the manufacture of pistons and other structural parts, which require a certain level of damage tolerance not adequately supplied by a brittle alloy. Thus, there is a need for hypereutectic Al—Si alloys with a higher solidus melting temperature and greater ductility. Alloys of the presently discussed embodiment having a microstructure consisting of primary aluminum dendrites, surrounded by both a strontium modified-eutectic structure and a refined primary silicon phase, can meet this need.

Normally, a hypereutectic Al—Si—Mg alloy consists of 90% or more eutectic and 10% or less primary silicon, the alloys of this embodiment causes the volume fraction of the eutectic to be partitioned, in a manner never before exhibited, into a higher silicon constitute, more primary silicon (surrounded by aluminum), and a lower silicon constitute, primary aluminum surrounded by a modified eutectic. The increase in volume fraction of primary silicon of small size increases the wear resistance, and the significant decrease in the eutectic volume fraction to primary aluminum (surrounded by modified eutectic) increases the ductility.

Referring now to FIG. 8, therein is shown a micrograph of the microstructure from a high pressure high pressure die cast engine block made from an alloy of this embodiment. As noted, the specific constituencies for this alloy are 19.2% by weight Si; 0.05% by weight Sr; 0.7% by weight Fe; and 0.46% by weight Mg, with the balance aluminum. It was unexpectedly found that hypereutectic aluminum silicon alloys with 0.05% to 0.10% strontium, when high pressure die cast, exhibit a microstructure with a refined primary silicon particle size less than 10 microns (μm). Typically, in the high pressure die casting process, a desirable primary silicon size is 20 μm. Accordingly, the small silicon particle size exhibited in the alloy of the present embodiment is nearly half the best size produced in die casting with phosphorous refinement of the primary silicon.

The alloys of this embodiment also demonstrate a modified eutectic with a eutectic silicon morphology that is fibrous in nature. Additionally, be a very large undercooling that produces dendritic primary aluminum with a dendrite arm spacing of 10 microns or less. This undercooling also produced an alpha aluminum halo around and between the primary silicon, because of a divorced eutectic reaction. As a result, an alloy of this embodiment will have a volume fraction of primary aluminum dendrites surrounded by a modified eutectic that is larger than the volume fraction of primary silicon surrounded by a divorced eutectic aluminum. The primary aluminum dendrites with a dendritic arm spacing of 10 microns or less, and the fibrous modified eutectic silicon in between the dendrite arm spacing and entirely around the aluminum dendrites are unexpected. These unique features have not been exhibited in production castings heretofore and are responsible for elongations in production parts that exceed 2% elongation, i.e., four times the elongation of strontium-free conventional hypereutectic Al—Si alloys. Specifically, standard testing revealed that the alloy had average ultimate tensile strength (UTS) of 263 MPa (or 38.1 ksi), a Yield Strength of 207 MPa (or 30.0 ksi) and an elongation of 2.1%. The elongation is four times the elongation of a typical hypereutectic Al—Si alloy of 0.5%, and higher than the elongation of a well annealed conventional hypereutectic Al—Si alloy.

Referring back to FIG. 8, the microstructure shown there consists of (1) small closely spaced irregular shaped silicon particle embedded in an aluminum matrix (because of a divorced eutectic reaction) and (2) larger aluminum dendrites embedded in a modified eutectic. The majority of the "primary" silicon particles are rather concentrated with very little space between the particles. This space between or around the silicon particles is effectively an aluminum alloy halo of very low silicon content. The area of the concentrated patches of many silicon particles with aluminum halos is less in area than the area of the primary aluminum dendrites that are embedded in the modified eutectic. With the majority of the primary silicon particles with a serrated appearance very close to one another and having a small particle size of less than 10 μm, it is clear that these particles never come in contact with each other because of the aluminum halo around the silicon particles. Thus, the silicon never fractures but effectively rejects the aluminum from the high silicon areas during solidification. These smaller primary silicon sized particles, surrounded by pure aluminum, as a result of the divorced eutectic reaction, accounts for the elongation being four times the elongation of convention hypereutectic Al—Si alloys. The good ductility associated primary aluminum is effective because between the dendritic arm spacing and around the entire primary aluminum dendrite the eutectic structure is modified.

Typically, the primary silicon phase of hypereutectic Al—Si alloys is not readily nucleated by impurities present in these alloys. As a result, phosphorous is consistently added to hypereutectic Al—Si alloy melts in permanent mold casting, and very frequently in die casting. The phosphorous, in amounts of about 100 to 500 ppm, reacts with the liquid aluminum to form aluminum phosphide, AlP, which has a crystal structure very similar to that of silicon, and acts as an effective heterogeneous nucleation site for the primary silicon. Strontium phosphide and sodium phosphide, however, are compounds that are more stable than aluminum phosphide and therefore a coarsening of the primary silicon is expected when strontium or sodium is added to the melt. The microstructure in FIG. 9 illustrates the scientific accepted logic of adding 0.016% strontium and having the primary silicon size, as expected, tripled in size. Adding more strontium in FIG. 10 to the 0.03% Sr level, which does not make sense to do based on FIG. 9, should further increase the primary silicon size, but instead resulted in irregularly shaped smaller primary silicon. Thus, an elongation of 2% and larger was found for a strontium content at 0.05% only for die casting cooling rates and not for permanent mold casting cooling rates. The optimal microstructure of FIG. 8 logically has to arise because the freezing process is not an equilibrium process but a quasi-equilibrium process, as suggested schematically in FIG. 17.

Referring now to FIG. 17, the primary silicon phase in conventional hypereutectic aluminum silicon alloys nucleates with the help of an aluminum phosphide particle at A below the liquidus temperature, and then begins to grow as the temperature follows the arrows to B where the unmodified eutectic forms. Similarly, in conventional hypoeutectic aluminum silicon alloys containing strontium the primary aluminum phase forms along the C-curve and grows as the temperature decreases until B is reached and a unmodified eutectic forms. Since the presence of strontium poisons the aluminum phosphide nucleus in hypereutectic aluminum silicon alloys, the primary silicon particles grow to large sizes and crack on machining. With the fast cooling rates of high pressure die casting applied to a hypereutectic aluminum silicon melt with no phosphorous and some strontium, the primary silicon phase nucleates first along a depressed A curve, with the silicon particles having a regular shaped morphology but having a very large particle size and these silicon particles would be surrounded by a melt very low in aluminum. This subsequently causes primary aluminum dendrites to form on solidification with a eutectic forming between the dendrite arms. With no phosphorus and significant levels of strontium in the melt, the primary silicon phase is prevented from nucleating first along the A curve, but would require a greater undercooling of the melt, likely to curve C. Under these quasi-equilibrium conditions, primary aluminum may precipitate along curve C, but almost immediately massive amounts of silicon would precipitate to balance the composition imbalance. Thus, the regular shaped silicon morphology does not form as expected because of the very large undercooling of the melt and the very rapid subsequent reaction rates when a nucleation site is found in these large undercooled melts. Further, using the same chemistries in making the samples with cooling rates slower than high pressure die casting did not produce any evidence in the microstructure of the primary aluminum phase as exhibited in FIG. 8. The results of adding various amounts of strontium modifier to a chill cast 391 alloy cooling at 29 C/sec are shown in FIGS. 9-10, and 12-16. Higher traditional concentrations of 0.05% Sr causes a change in the primary silicon morphology itself, resulting in a dendritic shape, as shown in FIGS. 10 and 12-16.

Accordingly, 0.016% strontium is normally added to the hypoeutectic aluminum silicon alloys to modify the eutectic silicon to a fibrous morphology from an acicular morphology in the eutectic structure and to increase mechanical properties (particularly elongation). This strontium addition, however, is not expected to be effective for die cast hypereutectic Al—Si alloys because the primary silicon particle size increases by a factor of three from the 0% strontium level and machining cracks all of these silicon particles. Thus, it is unexpected to achieve smaller silicon particles with increased strontium additions in hypereutectic aluminum silicon alloys. The inventive microstructure of FIG. 8 is obtained at die casting cooling rates and cannot be obtained with permanent mold cooling rates at 0.03% strontium or at higher silicon levels near 0.20% because in these permanent mold microstructures the primary silicon is very large and dendritic [i.e., not machinable] and the eutectic is modified but the cell boundaries are decorated with small Al4Sr particles that don't precipitate at the faster cooling rates of die casting. The inventive microstructure shown in FIG. 8 includes 0.05% strontium and demonstrates refined primary silicon. Referring now to FIG. 18 therein is shown the microstructure of a similar high pressure die casting alloy but with 0.022% by weight strontium. FIG. 18 shows refined primary silicon particles and the primary aluminum phase, but also a significant number of very large primary silicon particles that are larger than the aluminum dendrite arm spacing. These large primary silicon particles have an irregular shape and likely found aluminum phosphate (AlP) or other particles to nucleate on. This is why more strontium is needed, to react with and "poison" all the conventional nuclei for primary silicon. The data suggests that the minimum strontium level to eliminate the conventional nuclei for primary silicon in the inventive hypereutectic Al—Si alloy and produce the microstructure in FIG. 8 is 0.05% strontium.

The present invention is further detailed in the following examples. One of skill in the art will recognize that the Aluminum Association democracy of the current listed alloys 390, 391, 392 and 393 may be modified to the inventive microstructure of FIG. 8 through the addition of 0.05 to 0.10% by weight Sr. Accordingly, the present application contemplates a hypereutectic aluminum silicon alloy comprising 16-23% by weight silicon, 0.01 to 1.5% by weight iron, 0.20 to 5.0% by weight copper, 0.01 to 0.30% by weight manganese, 0.40 to 1.3% by weight magnesium, 0.05 to 0.10% by weight strontium, and the balance aluminum wherein the alloy as cast demonstrates an algorithm of greater than 2%.

EXAMPLES

Example 1

Pistons for an internal combustion engine were cast with an alloy according to the present invention and having the following specific constituents in weight percentage: 19% silicon, 0.6% magnesium, 4% nickel and balance aluminum. The pistons were cast using a traditional sand casting method. The cast pistons were heat treated and subsequently machined.

The machining of the pistons went so well that it was suspected that the alloy was not a hypereutectic aluminum silicon alloy. The machining results were so surprising that instead of carbide tooling or diamond tooling, high speed steel was sufficient to machine the pistons. Further, in comparison tests with pistons cast from AA B391, the pistons using the alloy of the present invention gave lower emission numbers than in pistons cast from AA B391. The lower emission numbers are attributable to higher temperature strength of the alloy of the present invention, as well as the lower the coefficient of thermal expansion of the alloy of the present invention.

Example 2

A two cylinder engine block was cast using the lost foam casting with pressure process wherein ten atmospheres of pressure were applied during solidification. The two cylinder engine block was cast from an alloy of the present invention and specifically comprising 19.1% silicon, 0.65% manganese and 5.2% nickel. After casting, the porosity level of the two cylinder block was measured to be 0.11%.

The porosity value of 0.11% is significantly lower than the best porosity levels (of approximately 0.35%) that have been measured for copper-containing hypereutectic aluminum silicon alloys solidified under 10 atmospheres of pressure under identical conditions in the identical foam blocks. The tensile strength from samples obtained from a block cast from the alloy of the present invention tested at 700° Fahrenheit had a tensile strength of 10.5 ksi. The machining results for a machining trial of 100 engine blocks were surprising as to the results in Example 1 with the pistons, and, accordingly, allowed for high speed steel machining.

The above demonstrated examples constitute 100% improvement in projected tool life for machining components constructed of alloys of the present invention versus machining components constructed of aluminum alloy B391. Since pistons, engine blocks and engine heads are engine components that require an extensive amount of machining after casting, this invention is particularly suited therefor.

Example 3

Three "as cast" tensile specimens were extracted from engine block that was high pressure die cast with the following constituencies: 19.2% by weight Si; 0.05% by weight Sr; 0.7% by weight Fe; and 0.46% by weight Mg, with the balance aluminum, and whose microstructure is shown in FIG. 8. Standard testing revealed that the alloy had average ultimate tensile strength (UTS) of 263 MPa (or 38.1 ksi), a Yield Strength of 207 MPa (or 30.0 ksi) and an elongation of 2.1%. The elongation is four times the elongation of a typical hypereutectic Al—Si alloy of 0.5%, and higher than the elongation of a well annealed conventional hypereutectic Al—Si alloy.

It should be apparent to those skilled in the art that the present invention as described herein contains several features, and that variations to the various embodiments disclosed herein may be made which embody only some of the features disclosed. Various other combinations, and modifications or alternatives may also be apparent to those skilled in the art. Such various alternatives and other embodiments are contemplated as being within the scope of the following claims which particularly point out and distinctly claim the subject matter regarded as the invention.

What is claimed is:

1. A hypereutectic high pressure die cast aluminum silicon alloy comprising: 16% to 23% by weight silicon; 0.01% to 1.5% by weight iron; 0.01% to 0.6% by weight manganese; 0.01% to 1.3% by weight magnesium; 0.05% to 0.20% by weight strontium and the balance aluminum; wherein the high pressure die cast alloy has a microstructure with a volume fraction of primary silicon of greater than 10%, and an elongation of at least 2%.

2. The hypereutectic aluminum silicon alloy of claim 1, wherein the alloy has a microstructure with a volume fraction of primary silicon at 10% to 20%, a volume fraction of modified aluminum-silicon eutectic at 45% to 90%, and the balance of the microstructure primary aluminum.

3. The hypereutectic aluminum silicon alloy of claim 2, wherein the volume fraction of primary silicon is surrounded by eutectic aluminum.

4. The hypereutectic aluminum silicon alloy of claim 2, wherein the volume fraction of modified aluminum-silicon eutectic includes fibrous eutectic silicon.

5. The hypereutectic aluminum silicon alloy of claim 2, wherein the microstructure primary aluminum is dendritic with an average dendritic arm spacing of less than 15 μm.

6. The hypereutectic aluminum silicon alloy of claim 1, wherein the high pressure die cast aluminum silicon alloy comprises 0.01% to 0.7% by weight iron.

7. The hypereutectic aluminum silicon alloy of claim 1, wherein the high pressure die cast aluminum silicon alloy comprises 0.01% to 0.2% by weight iron.

8. The hypereutectic aluminum silicon alloy of claim 1, wherein the high pressure die cast aluminum silicon alloy comprises 0.01% to 0.5% by weight manganese.

9. The hypereutectic aluminum silicon alloy of claim 1, wherein the high pressure die cast aluminum silicon alloy further comprises 0.01% to 4.5% by weight nickel.

10. The hypereutectic aluminum silicon alloy of claim 1, wherein the high pressure die cast aluminum silicon alloy comprises 0.05% to 0.1% by weight strontium.

11. The hypereutectic aluminum silicon alloy of claim 1, wherein the high pressure die cast aluminum silicon alloy has an average ultimate tensile strength of greater than 250 MPa.

12. The hypereutectic aluminum silicon alloy of claim 1, wherein the high pressure die cast aluminum silicon alloy has a yield strength of greater than 200 MPa.

13. A hypereutectic aluminum silicon alloy microstructure comprising: a volume fraction of primary silicon at 10% to 20%, a volume fraction of modified aluminum-silicon eutectic at 45% to 90%, and the balance of the microstructure primary aluminum.

14. The hypereutectic aluminum silicon alloy microstructure of claim 13, wherein the volume fraction of primary silicon is surrounded by eutectic aluminum.

15. The hypereutectic aluminum silicon alloy microstructure of claim 14, wherein the volume fracture of primary aluminum, including eutectic aluminum surrounding the primary aluminum is larger than the volume fraction of primary silicon.

16. The hypereutectic aluminum silicon alloy microstructure of claim 13, wherein the volume fraction of primary silicon is surrounded by a modified eutectic containing a fibrous eutectic silicon phase.

17. The hypereutectic aluminum silicon alloy microstructure of claim 13, wherein the microstructure primary aluminum is dendritic with an average dendritic arm spacing of less than 15 μm.

18. The hypereutectic aluminum silicon alloy microstructure of claim 17 wherein the primary aluminum dendritic arm spacing is larger than the average primary silicon particle size.

19. The hypereutectic aluminum silicon alloy microstructure of claim 13, wherein the alloy microstructure exhibits an elongation of at least 2%.

20. The hypereutectic aluminum silicon alloy microstructure of claim 13, wherein the alloy microstructure exhibits an average ultimate tensile strength of greater than 250 MPa.

21. The hypereutectic aluminum silicon alloy microstructure of claim 13, wherein the alloy microstructure exhibits yield strength of greater than 200 MPa.

22. The hypereutectic aluminum silicon alloy microstructure of claim 13, wherein the average primary silicon particle size is less than 10 μm.

23. A hypereutectic aluminum silicon alloy comprising 16-23% by weight silicon, 0.01 to 1.5% by weight iron, 0.20-5% by weight copper, 0.01 to 4.5% by weight nickel, 0.01 to 0.30% by weight manganese, 0.40-1.3% by weight magnesium, 0.05 to 0.10% by weight strontium, and the balance aluminum wherein the alloy when cast demonstrates an elongation of greater than 2%.

* * * * *